US005664511A

United States Patent [19]

Tajima et al.

[11] Patent Number: 5,664,511

[45] Date of Patent: Sep. 9, 1997

[54] THREAD CUTTER AND DRIVE UNIT FOR A CHAIN STITCH SEWING MACHINE

[75] Inventors: Ikuo Tajima; Satoru Suzuki; Yoichi Mizuguchi, all of Kasugai, Japan

[73] Assignee: Tokai Industrial Sewing Machine Co., Ltd., Aichi, Japan

[21] Appl. No.: 614,668

[22] Filed: Mar. 13, 1996

[51] Int. Cl.[6] ..... D05B 65/00

[52] U.S. Cl. ..... 112/292; 112/166; 112/201

[58] Field of Search ..... 112/98, 83, 84, 112/80.42, 80.44, 87, 166, 165, 220, 298, 292, 201

[56] References Cited

U.S. PATENT DOCUMENTS

| | | | |
|---|---|---|---|
| 3,481,291 | 12/1969 | Schilling | 112/98 |
| 3,532,065 | 10/1970 | Marforio | 112/292 |
| 3,595,188 | 7/1971 | Schmedding | 112/98 X |
| 4,543,897 | 10/1985 | Heinzle | 112/98 X |

FOREIGN PATENT DOCUMENTS

| | | | |
|---|---|---|---|
| 1119955 | 7/1968 | United Kingdom | 112/292 |

*Primary Examiner*—Ismael Izaguirre
*Attorney, Agent, or Firm*—Koda and Androlia

[57] ABSTRACT

A thread cutter for a chain stitch sewing machine which performs chain stitch sewing by cooperation of a needle driven up and down and a looper arranged under a needle plate, including: a movable knife arranged so that it can advance into or retract from a gap between a top surface of the looper and an under surface of the needle plate; a knife driving mechanism for advancing and retracting the movable knife; a stationary knife arranged under the needle plate for cutting a sewing thread in cooperation with the movable knife when the movable knife is retracted; and a thread holding plate for holding a cut end of the sewing thread on the side of the looper in a predetermined position by a further retracting operation of the movable knife after the sewing thread is cut and a drive unit for a multi-sewing machine.

3 Claims, 20 Drawing Sheets

(a)

(b)
53
60
64
58
58a
77
75
76
66
64
65
61
a
17f
17
17d
66c
68a
52
66a
67
67a
55
66b
68
68
66
53d
53
53a
53c
66d
53b
64
65
65
65
17
17f
17d
17
58
17

THREAD CUTTER AND DRIVE UNIT FOR A CHAIN STITCH SEWING MACHINE

BACKGROUND OF THE INVENTION

1. Field of the Invention

This invention relates to a thread cutter for a chain stitch sewing machine which performs chain stitch sewing by cooperation of a needle that is driven up and down and a looper that is controlled for rotation in synchronization with the needle. Another invention of the subject application relates to a drive unit for a multi-head sewing machine where a needle bar and a cloth pressing member, arranged in each of a plurality of machine heads, are moved up and down.

2. Description of the Related Art (Prior art of the first invention)

A conventional thread cutter for a chain stitch sewing machine is disclosed, for example, in Japanese Patent Publication No. HEI 3-11239. This publication discloses a thread cutting mechanism where a sewing thread is cut by cooperation of a movable knife that advances into or retracts from a gap between the under surface of a needle plate and the top surface of a looper and a stationary knife fixed to the under surface of the needle plate. Japanese Unexamined Patent Publication No. HEI 5-239757 discloses another conventional thread cutter, which includes a scissor type cutting mechanism, a thread guiding mechanism for guiding a sewing thread to the cutting mechanism, and a thread holding mechanism for holding the sewing thread after it is cut.

The thread cutter, disclosed in the aforementioned Japanese Patent Publication No. HEI 3-11239, is not equipped with a mechanism for holding the end of the thread remaining on the looper side after it is cut in a predetermined position. For this reason, when a needle is threaded by rotation of the looper at the time of the start sewing operation, the thread end will be moved due to the rotation of the looper. Therefore, tension cannot be applied to the sewing thread and in certain cases the needle cannot be threaded appropriately, and consequently the drawback is pointed out that errors can occur in the start of the sewing operation.

The thread cutter, disclosed in the aforementioned Japanese Unexamined Patent Publication No. HEI 5-239757, is equipped with a mechanism for holding the end of the thread remaining on the looper side after it is cut in a predetermined position. However, because the thread cutter is structurally complicated due to a large number of components, there is the drawback that the production cost is increased and that the operation cannot be performed with reliability.

(Prior art of the second invention)

In multi-head sewing machines, the drive unit for elevating needle bars and cloth pressing members individually arranged in a plurality of machine heads rotates the needle cam and the cloth pressing cam fixed on the main machine shaft, and in association with these rotations, repeats reciprocating movement of the needle bar driving lever and the cloth pressing member driving lever over a constant range, whereby the needle bar and the cloth pressing member are individually moved up and down. When the needle bar and the cloth pressing member are required to be retracted for exchange of a piece of cloth, installed retracting mechanism is operated so that the driving levers are moved upward beyond the constant range, whereby the needle bar and the needle pressing member are retracted to a position beyond the top dead point of the sewing operation.

However, even in the state where the needle bar and the cloth pressing member have been retracted, if the main machine shaft is rotating, the respective driving levers will be interlocked depending upon the rotational positions of the needle bar cam and cloth pressing member. Therefore, in certain cases the needle bar and the cloth pressing member continue their operations although they are in incomplete operations. Therefore, in order to stop an arbitrary machine head of the multi-head sewing machine, it is necessary that the needle bar and cloth pressing member of that machine head be retracted and at the same time the interlocked relationship between the main machine shaft and each cam be cut off by a clutch mechanism. However, because the clutch mechanism has to be arranged in correspondence With the respective machine heads, there is the problem that the drive unit becomes structurally complicated.

SUMMARY OF THE INVENTION

This invention has been made in order to overcome the aforementioned drawbacks inevitably inherent in the conventional thread cutters and drive units.

Accordingly, it is an object of the invention to provide an improved thread cutter for a chain stitch sewing machine where, when the sewing thread guided through a looper is cut by a thread cutting mechanism, the vicinity of the cut end can be held by a thread holding member and also a needle can be threaded with reliability.

Another object of the invention is to provide an improved drive unit for a multi-head stitch sewing machine where, if only the retracting operation of the needle bar and cloth pressing member of an arbitrary machine head that is desired to be stopped is performed, the interlocked relationship between the needle bar cam and the needle bar driving lever and between the cloth pressing member and the cloth pressing member driving lever can be cut off, and which is capable of making the conventional clutch mechanisms provided in each machine head unnecessary and is structurally simple.

To achieve the foregoing objects and in accordance with one aspect of the present invention, there is provided a thread cutter for a chain stitch sewing machine which performs chain stitch sewing by cooperation of a needle driven up and down and a looper arranged under a needle plate, comprising a movable knife arranged so that it can advance into or retract from a gap between a top surface of the looper and an under surface of the needle plate; a knife driving mechanism for advancing and retracting the movable knife; a stationary knife arranged under the needle plate for cutting a sewing thread in cooperation with the movable knife when the movable knife is retracted; and a thread holding plate for holding a cut end of the sewing thread on the side of the looper in a predetermined position by a further retracting operation of the movable knife after the sewing thread is cut.

In accordance with another aspect of the present invention, there is provided a thread cutter for a chain stitch sewing machine which performs chain stitch sewing by cooperation of a needle driven up and down and a looper arranged under a needle plate, comprising a movable knife arranged so that it can advance into or retract from a gap between a top surface of the looper and an under surface of the needle plate; a knife driving mechanism for advancing and retracting the movable knife; a stationary knife arranged under the needle plate for cutting a sewing thread in cooperation with the movable knife when the movable knife is retracted; a thread holding plate for holding a cut end of the sewing thread on the side of the looper in a predetermined position by a further retracting operation of the movable knife after the sewing thread is cut; and a thread releasing member provided in the movable knife for releasing the thread holding force of the thread holding plate by a reciprocating operation of the movable knife at the time of sewing.

In accordance with still another aspect of the present invention there is provided a thread cutter for a chain stitch sewing machine which performs chain stitch sewing by cooperation of a needle driven up and down and each of a plurality of loopers arranged under a needle plate, comprising a looper support for supporting the plurality of loopers, the looper support being slidably arranged under the needle plate; a looper selecting mechanism for sliding the looper support so that one of the plurality of loopers is positioned opposite and under the needle; a movable knife arranged so that it can advance into or retract from a gap between a top surface of the selected looper and an under surface of the needle plate; a knife driving mechanism for advancing and retracting the movable knife; a stationary knife arranged under the needle plate for cutting a sewing thread in cooperation with the movable knife when the movable knife is retracted; a thread holding plate for holding a cut end of the sewing thread on the side of the looper in a predetermined position by a further retracting operation of the movable knife after the sewing thread is cut; and a thread releasing member provided in the movable knife for releasing the thread holding force of the thread holding plate by a reciprocating operation of the movable knife at the time of sewing.

In accordance with a further aspect of the present invention, there is provided a drive unit for a multi-head sewing machine which is provided with a plurality of machine heads each including a main machine head, a needle bar cam and a cloth pressing cam fixed to the main machine shaft so that the bar cam and the pressing cam can rotate together with the main machine shaft, a needle bar driving lever and a cloth pressing member driving lever which repeat a reciprocating movement over a predetermined range in response to rotation of the needle cam and rotation of the cloth pressing cam so that a needle bar and a cloth pressing member can move up and down, and a retracting mechanism for moving the needle bar driving lever and the cloth pressing member driving lever upward beyond the predetermined range so that the needle bar and the cloth pressing member can retract upward, and where the main machine shaft penetrates the plurality of machine e heads so that it can be driven for rotation, characterized in that an actuator for driving the corresponding retracting mechanism is individually arranged in the corresponding machine head; and when the retracting mechanism of one of the plurality of machine heads is operated to retract the needle bar and the cloth pressing member, an interlocked relation between the needle bar cam and the needle bar driving lever and an interlocked relation between the cloth pressing cam and the cloth pressing member driving lever are cut off in the one of the plurality of machine heads.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

(First embodiment)

Figure 1:
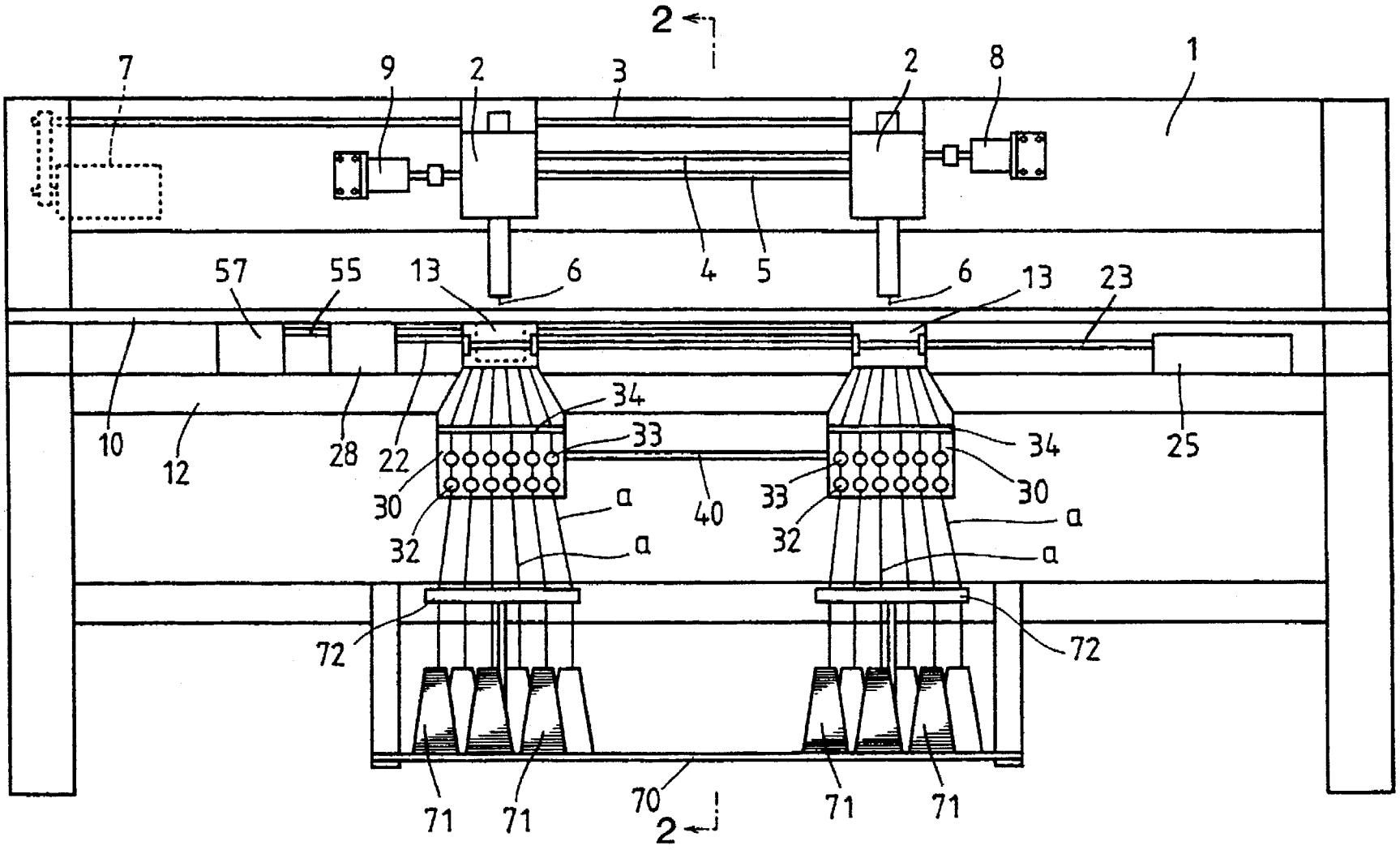
FIG. 1 is a front elevational view showing a thread selectable multi-head chain stitch sewing machine to which a thread cutter according to the first aspect of the present invention may be applied.

A preferred embodiment of a thread cutter for a chain stitch sewing machine according to the present invention will hereinafter be described with reference to the accompanying drawings. FIG. 1 shows a thread selectable multi-head chain stitch sewing machine to which the thread cutter according to the present invention may be applied. On the front surface of an upper frame 1 constituting the sewing machine, two machine heads 2, for example, are spaced at a predetermined interval, and a main machine shaft 3, a needle position control shaft 4, and a direction control shaft 5 are disposed so that the shafts penetrate the machine heads 2. Among these shafts, the main machine shaft 3 is operatively connected through a speed reducer to a servo motor 7 provided in the left rear portion of the upper frame 1, and by rotation of the main shaft 3, needles 6 provided in the machine heads 2 are reciprocated up and down through a mechanism (not shown). Also, the needle position control shaft 4 and the direction control shaft 5 are driven by pulse motors 8 and 9 fixed to the front surface of the upper frame 1, respectively. With this arrangement, the stroke height of the needles 6 is controlled through a mechanism (not shown) by rotation of the position control shaft 4, and the direction of the needles 6 (orientation of the needle portion) is controlled by rotation of the direction control shaft 5.

Figure 2:
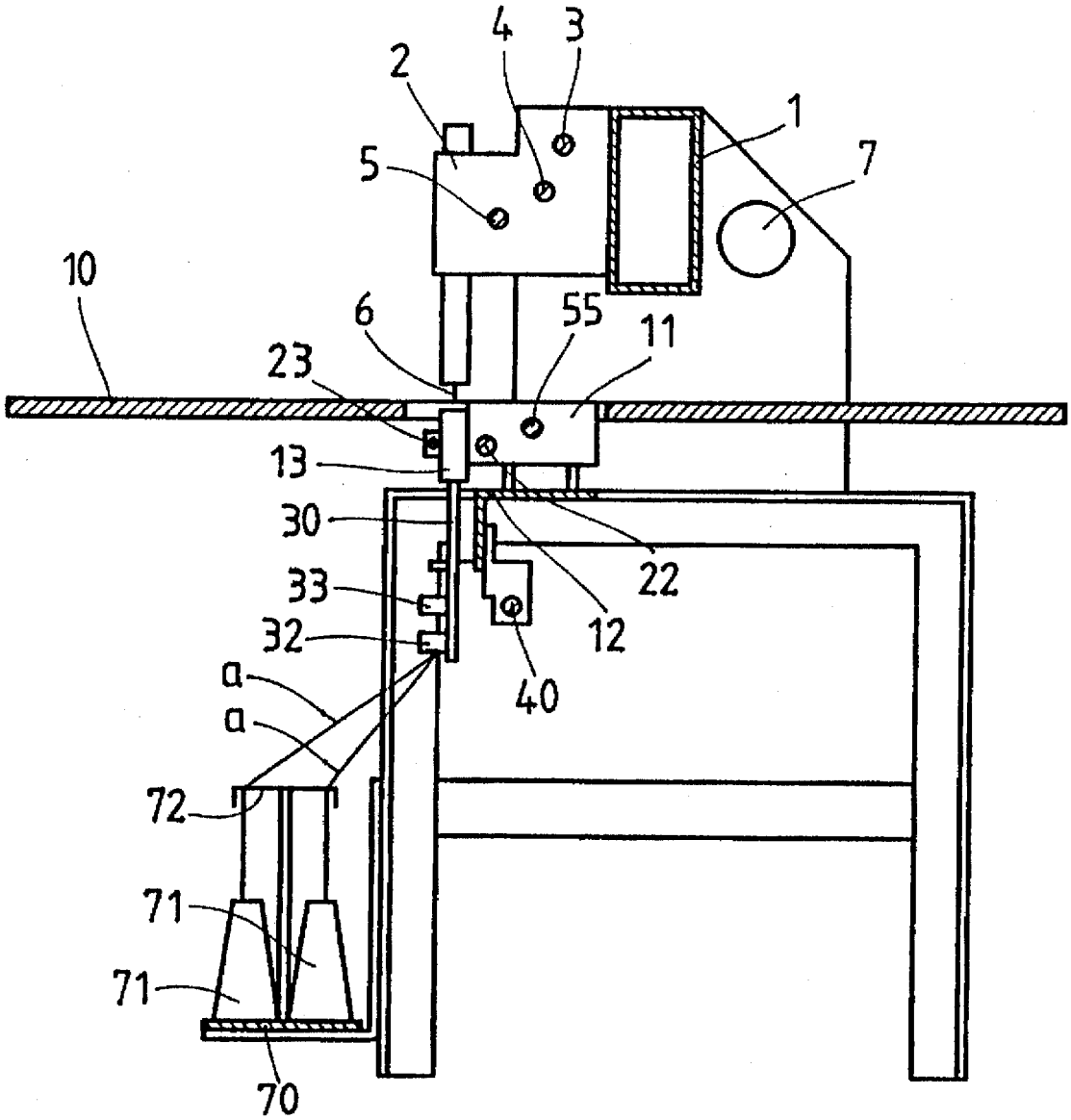
FIG. 2 is a sectional view of the chain stitch sewing machine taken substantially along the line 2—2 in FIG. 1.
Figure 4:
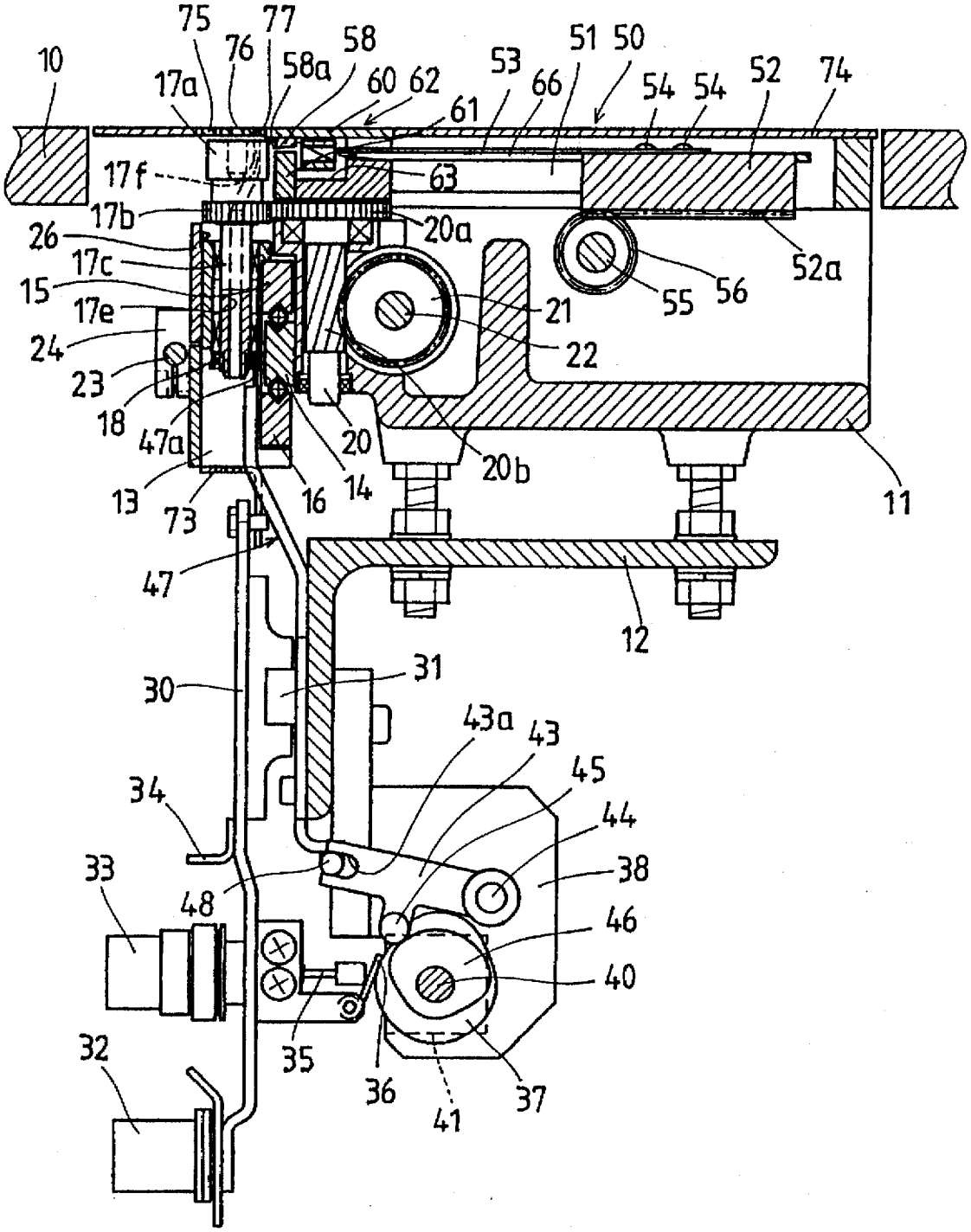
FIG. 4 is a side elevational view in cross-section of FIG. 3.

As shown in FIG. 2, gear boxes 11 are fixed at the positions corresponding to the machine heads 2 to a lower frame 12 positioned under a machine table 10. On the front surfaces of these gear boxes 11, two supports 13 for supporting loopers to be described later (hereinafter referred to as a "looper support") are mounted in association with the machine heads 2. Each of these looper supports 13 is formed into a box shape for supporting a plurality of loopers 17. As shown in FIG. 4, a horizontally extending linear rail 14, fixed to the front surface of the gear box 11, is clamped from the top and the bottom by upper and lower linear rails 15 and 16 fixed to the rear surface of the looper support 13. With this arrangement, the looper supports 13 are slidable in the right and left directions of FIG. 1 along the linear rail 14.

Figure 3:
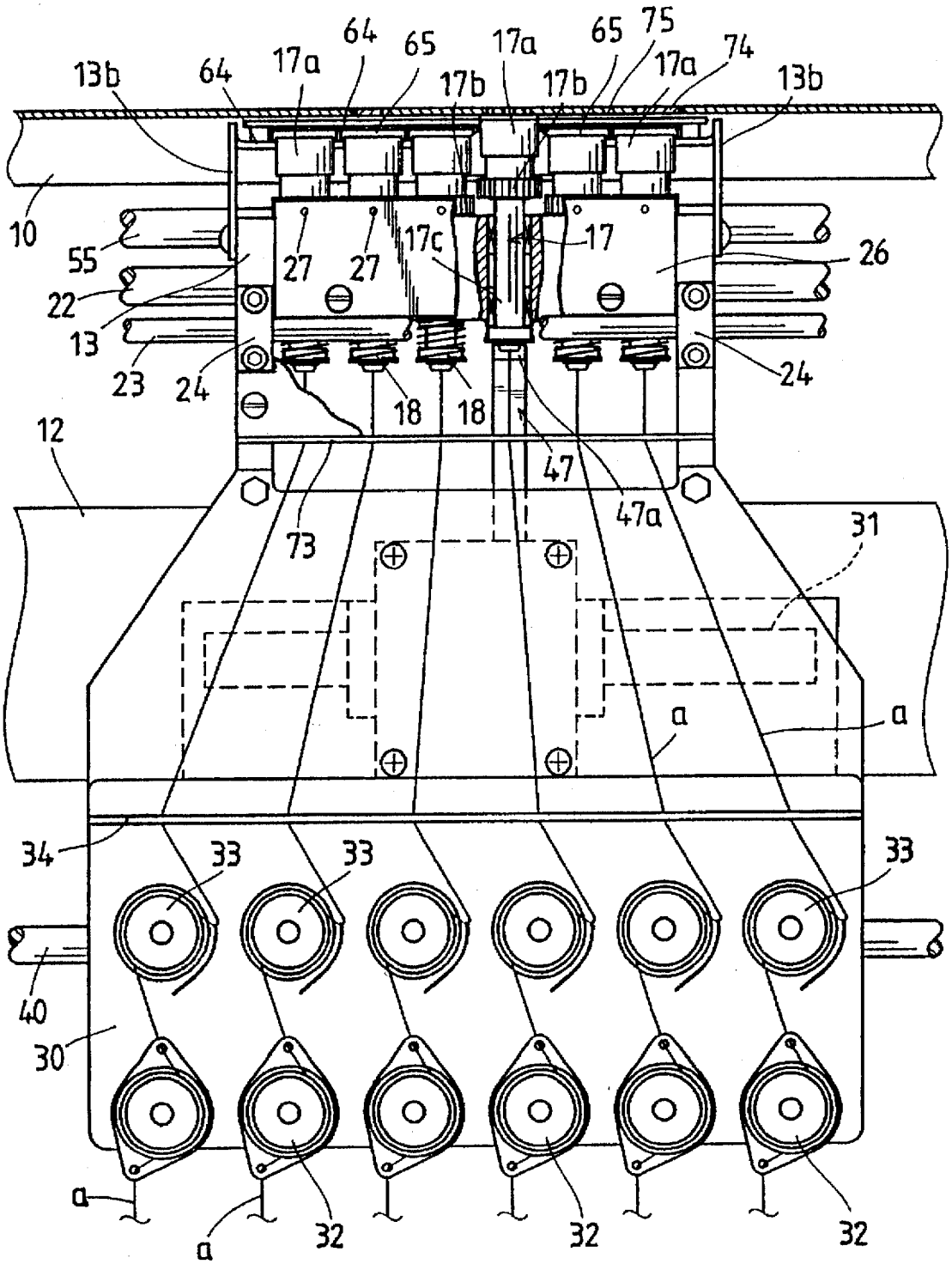
FIG. 3 is an enlarged front view showing the looper support and the thread tension Conditioning base plate of FIG. 1.
Figure 5:
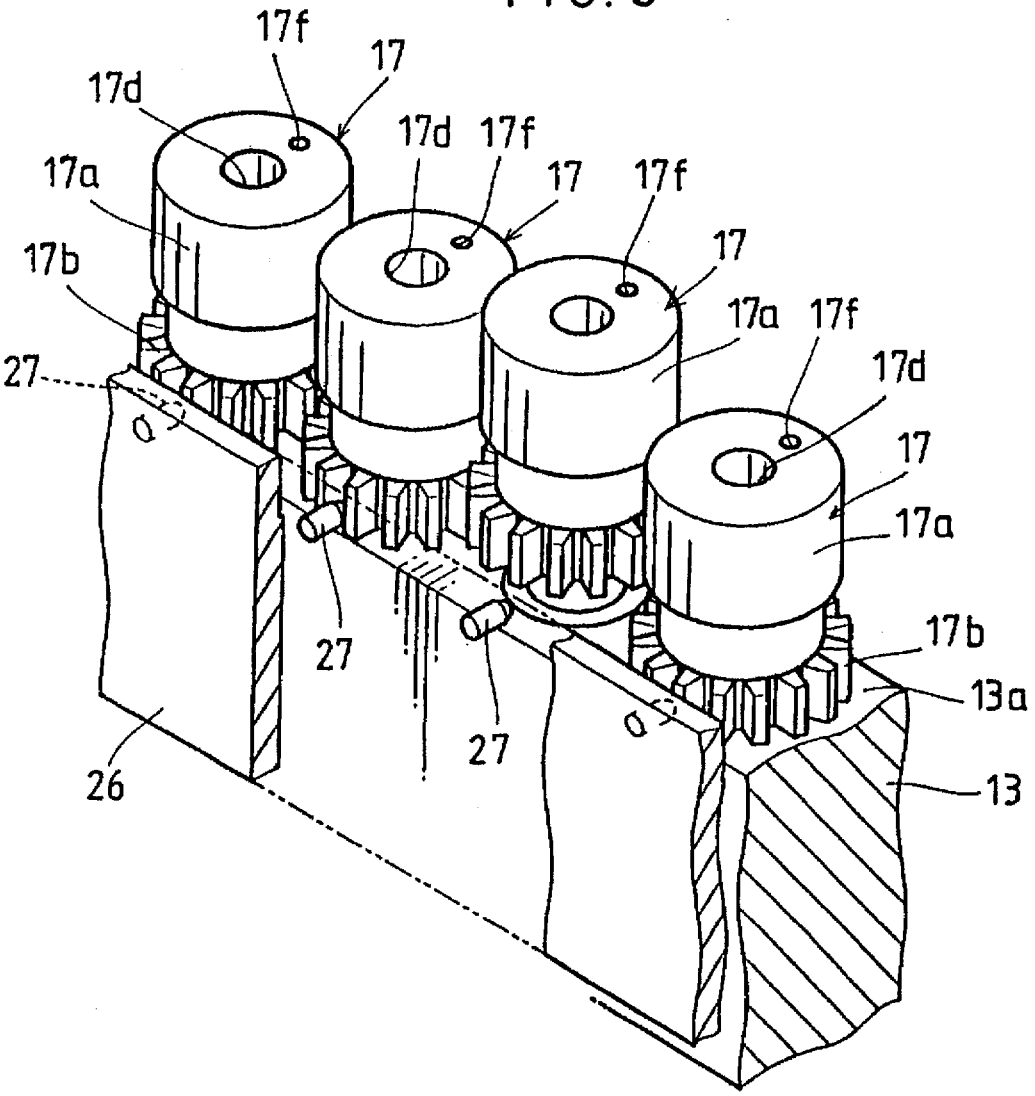
FIG. 5 is an enlarged perspective view showing part of the looper support.

On the top surface of each looper support 13, the plurality of loopers 17 (in this are embodiment 6 loopers) are vertically supported at predetermined intervals along the sliding direction of the looper support so that the loopers 17 are rotatable and freely movable up and down. This looper 17 is constituted by a cylindrical member where the diameter dimension varies along the longitudinal direction, and as shown in FIGS. 3 and 4, a spur gear portion **17*b* is formed at a position downwardly away from a head portion 17*a* by a predetermined distance, and an axial portion 17*c* is formed under the spur gear portion 17*b*. In addition, a dead hole 17*d* for allowing the lowering of the needle 6 is formed in the central portion of the top surface of the head portion 17*a*, and also the upper portion of a threading hole 17*e*, formed in the longitudinal central portion of the axial portion 17*c*, is opened up to the top surface of the head portion 17*a* and becomes a thread conducting hole 17*f*. Furthermore, the looper 17 is elastically urged downward at all times by means of a coil spring 18 mounted on the lower end of the looper 17. With this spring 18, the spur gear portion 17*b* of the looper 17 is held in its lower position on the top surface 13*a* of the looper support 13. In this state, as shown in FIG. 5, a positioning pin 27 of a front plate 26 fixed to the front surface of looper support 13 is inserted into the tooth space of the spur gear portion 17*b* of the looper 17 so that the looper 17 is non-rotatably positioned. At the same time, the thread conducting hole 17*f* of the looper 17 is held in the position oriented from the dead hole 17*d* of the looper 17 toward the front surface of the gear box 11 (rear surface of the looper support 13**).

As shown in FIG. 4, a driving gear 20 is rotatably mounted in the front central portion of each gear box 11. At the upper portion of this driving gear 20, there is formed a spur gear portion **20*a* meshing with the spur gear portion 17*b* of the looper 17, while at the lower portion, there is formed a screw gear portion 20*b* serving as a worm wheel. The screw gear portion 20*b* of the driving gear 20 meshes with a driving Screw gear 21 functioning as a worm, provided in the gear box 11. This driving screw gear 21 is fixed to a driving shaft 22 penetrating the gear boxes 11, and by the reciprocating rotation of the driving shaft 22, the driving gear 20 is reciprocated and rotated through the driving screw gear 21 fixed to the driving shaft 22 and through the screw gear portion 20*b* of the driving gear 20. The driving shaft 22 is coupled to the motor shaft of a pulse motor 28 fixed to the lower frame 12**.

A connecting rod 23 is arranged on the front surfaces of the looper supports 13 as shown in FIGS. 1, 3 and 4. This connecting rod 23 is fixed to each looper support 13 through connecting blocks 24 fixed to the opposite ends of the front surface of the looper support 13. The right end portion of the connecting rod 23 is connected to a looper selecting mechanism 25 provided in the vicinity of the end portion of the lower frame 12. The looper selecting mechanism 25 is used to move the connecting rod 23 in the axial direction, based on a looper selection signal. This movement of the connecting rod 23 causes both looper supports 13 to synchronously move along the linear rail 14. One of the plurality of loopers 17 on each looper support 13 is disposed in opposition to the driving gear 20 so that the looper 17 performs a function to be described later.

As shown in FIGS. 1 and 4, a thread tension conditioning base plate (hereinafter simply referred to as "thread condition base") 30, is coupled to each looper support 13. A recessed member, attached to the back surface of the thread condition base 30, is fitted on a linear rail 31 attached on the front surface of the lower frame 12. Thus, the thread condition base 30 is supported by the linear rail 31 so that it can move in the lateral direction. Therefore, as will be described later, the thread condition base 30 is movable integrally with the looper support 13 when the selecting operation of the looper 17 is performed by the looper selecting mechanism 25. As clearly shown in FIG. 1, six pairs of a first thread tension conditioner 32 and a second thread tension conditioner 33 are provided on the front surface of the thread condition base 30 in the horizontal direction in association with the number of loopers 17. Among these, each second thread tension conditioner 33 is provided with a thread tension regulating pin 35 on the back side thereof across the thread condition base 30. The thread tension regulating pin 35 is always urged into the back side direction by means of an elastic member such as a spring. On the back sides of the thread tension regulating pins 35, there is provided a press plate 36 which laterally extends to push in six thread tension regulating pins 35 at the same time.

The press plate 36 is pivotably supported at its lower end, and the pushing operation of the press plate 36 is performed by rotation of a first plate cam 37 provided on the back side of the press plate 36. The first plate claim 37 is fixedly mounted on a rotational shaft 40, which is rotatably supported by brackets 38 fixed to the lower frame 12 in association with each thread condition base 30. The rotational shaft 40 is connected to the motor shaft of a pulse motor 41 fixed to one bracket 38 (see FIG. 4). Therefore, if the rotational shaft 40 is rotated by the pulse motor 41 so that the thread tension regulating pin 35 is pushed in through the first plate cam 37 and the press plate 36, then application of tension to a sewing thread a being guided with the second thread tension conditioner 33 will be released. If, on the other hand, the pushing of the thread tension regulating pin 35 is released, application of tension to a sewing thread a will be performed. Also, a horizontally extending thread guide 34 is fixed to the vertical central portion of the front surface of the thread condition base 30 so that the sewing thread a being guided by the second thread tension conditioner 33 passes through the thread guide 34.

As shown in FIG. 4, a pivot arm 43 is pivotably supported by means of a pin 44 of the bracket 38. This pivot arm 43 is pivoted by the operation of the engagement between a cam follower 45 provided in the longitudinal central portion of the arm 43 and a second plate cam 46 fixed to the rotational shaft 40. Also, the free end of the pivot arm 43 is engaged with a driving lever 47 for moving the looper 17 upward. That is, the driving lever 47 is supported so that it can move up and down on the front surface of the lower frame 12. The driving lever 47 has at its upper end a push-up portion 47*a* for pushing up the lower end of the looper 17, and a pin 48 projecting from the lower end portion of the driving lever 47 is fitted into the engagement groove 43*a* formed in the free end of the pivot arm 43. The pivot arm 43 is urged in a counterclockwise direction in FIG. 4 so that the driving lever 47 is urged downward.

Figure 7:
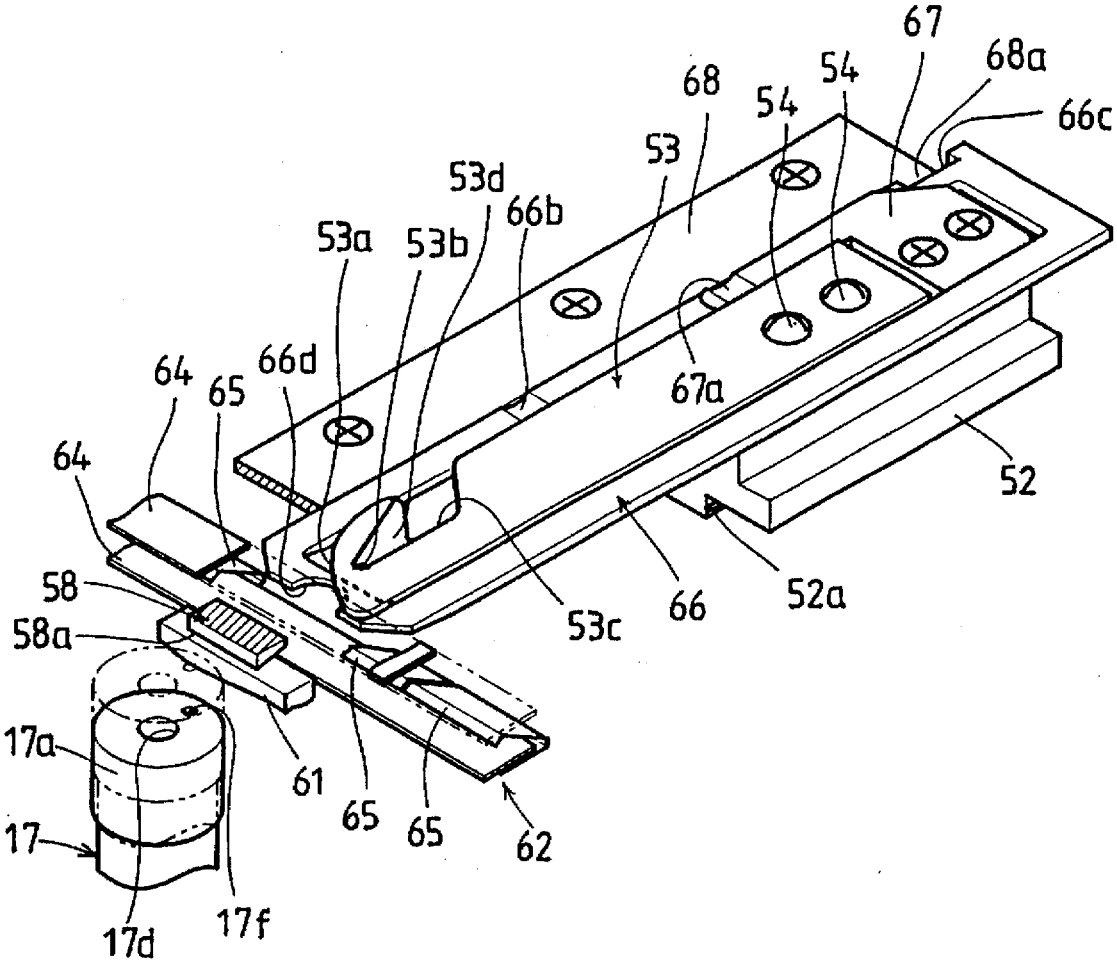
FIG. 7 is a perspective view of a thread cutting mechanism.

Furthermore, a thread cutting mechanism generally designated by reference numeral 50 is provided above each gear box 11. In this thread cutting mechanism 50, a slider 52 is fitted on a guiding portion 51, which horizontally extends and is formed on the upper portion of the gear box 11. Also, a movable knife 53 having a predetermined length in the longitudinal direction is fixed on the top surface of the slider 52 by means of screws 54. The under surface of the slider 52 is formed with a rack 52*a* meshing with a pinion 56 fixed to a driving shaft 55 disposed so as to penetrate each gear box 11. The knife driving shaft 55, as shown in FIG. 1, is connected to the motor shaft of a pulse motor 57 fixed to the lower frame 12. By the actuation of the pulse motor 57, the slider 52 is reciprocated in the longitudinal direction. Also, the front end portion of the movable knife 53, as shown in FIG. 7, is formed with a thread guiding portion 53*a*, a circular arc-shaped blade portion 53*b*, a thread capturing portion 53*c*, and a thread dropping portion 53*d* extending between the thread capturing between the thread capturing portion 53*c* and the blade portion 53*b*. When the movable knife 53 is in its stand-by position shown in FIG. 8, the front end thereof is retracted into a position rearwardly away from the looper 17.

As shown in FIGS. 4 and 7, a stationary knife 58 having nearly the same width as the movable knife 53 is provided in the rearward position of the looper 17 selected by the looper selecting mechanism 25 (looper 17 in the position opposed to the driving gear 20). This stationary knife 58 is fixed on the under surface of the front portion of a supporting plate 60 fixed on the top surface of the gear box 11, and the lower edge of the front end of the knife 58 is formed as a cut portion 58*a*. Also, a supporting block 61 is provided under the stationary knife 58, and between the top surface of the supporting block 61 and the under surface of the stationary knife 58, a gap is formed which allows the passing through of the front end portion of the movable knife 53.

A space 63 with a predetermined size, as shown in FIG. 4, is defined between the front end of the movable knife 53 and the rear end of the stationary knife 58.

Figure 13:
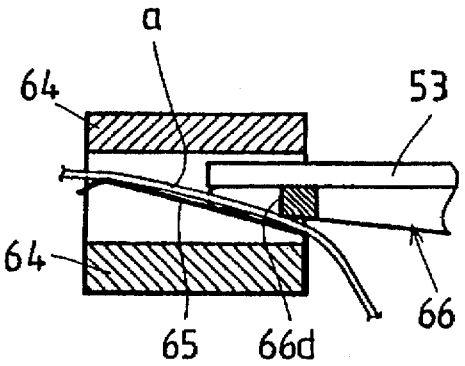
FIG. 13 is an enlarged sectional view showing the thread holding plate.

In this space a thread holding plate 62 is accommodated. The thread holding plate 62, as shown in FIGS. 3 and 7, is constituted by a pair of vertical brackets 13*b* and 13*b* fixed to the lateral opposite ends of the looper support 13 and a pair of upper and lower support plates 64 and 64 spaced between the vertical brackets 13*b* and 13*b* by a predetermined width. Between these two support plates 64 and 64, six hold plates 65 for the Sewing thread a are provided as shown in FIGS. 3, 7, and 13. Each hold plate 65 comprises a wedge-shaped elastic plate with a width slightly wider than the head portion 17*a* of the looper 17, and the hold plates are arranged in parallel with the opening end of each plate directed toward the corresponding looper 17, as shown in FIG. 7. When this hold plate 65 is arranged, the upper end of the taper portion thereof elastically contacts the under surface of the upper support plate 64. The thread holding plate 62 moves together with the looper support 13 through the vertical brackets 13*b* and 13*b* at the time of the selection of the looper 17, and consequently, the hold plate 65 corresponding to the selected looper 17 is held in the position opposite to the rear end of the stationary knife 58.

The slider 52 having the movable knife 53 fixed thereto is provided with a thread releasing member 66 in the form of a rectangular frame. This thread releasing member 66 is a frame member mounted on the slider 52 at the position where the height is lower than the movable knife 53 by one step. The thread releasing member 66 is movable together with the slider 52 by a spring plate 67 fixed on the top surface of the slider 52. For this purpose, a rear recessed portion 66*a* and a front recessed portion 66*b* are formed on one of the side portions of the thread releasing member 66 at positions spaced by a predetermined length along the longitudinal direction of the thread releasing member 66. In addition, a projected portion 67*a* engageable with both recessed portions 66*a* and 66*b* is formed on the fore end of a projected portion of the spring plate 67. When the projected portion 67*a* is engaged with either the rear recessed portion 66*a* or front recessed portion 66*b*, the thread releasing member 66 is integrally coupled to the slider 52. In this connected state, if the slider 52 is advanced or retracted with respect to the looper 17, the thread releasing member 66 will be guided between guide plates 68 and 68 disposed on both sides of the movable knife 53 and will be moved together with the slider 52.

A longitudinally extending cutout 66*c* with a required length is formed in the vicinity of the rear end of the thread releasing member 66 on the side where the recessed portions 66*a* and 66*b* are formed. This cutout 66*c* is engaged with a releasing-body regulating pin portion 68*a* provided in the rear end of one of the guide plates 68, and consequently, the thread releasing member 66 is movable in the traveling direction of the slider 52 by a predetermined distance. When the slider 52 is in the stand-by position shown in FIGS. 7 and 8, the projected portion 67*a* of the spring plate 67 is fitted into the rear recessed portion 66*a* of the thread releasing member 66 (see FIG. 12(*a*)) and also the releasing-body regulating pin portion 68*a* of the guide plate 68 is brought into contact with the front wall of the cutout 66*c* of the thread releasing member 66. In this state, the front end of the movable knife 53 and the front end of the thread releasing member 66 are vertically. aligned with each other. Also, a nearly circular-shaped escape groove 66*d* is formed at the central portion in the width direction of the front end of the thread releasing member 66. The upper open end of the gear box 11 where the thread cutting mechanism 50 is disposed and the upper open end of the looper support 13 are closed by a cover plate 74. Also, a needle plate 75 is provided just above the selected looper 17. The needle plate 75 is provided with a needle dropping hole 76 through which a needle 6 is dropped. A threading hole 77 is formed around the needle dropping hole 76.

As shown in FIGS. 1 and 2, a bobbin mounting plate 70 is disposed in a position lower than the thread condition bases 30, and six bobbins 71 are mounted on the bobbin mounting plate 70 for each thread condition base 30. The bobbin 71 is used for supplying a sewing thread a to the thread condition base 30. The sewing thread a, unwound from each bobbin 71, is first guided by a thread guide 72, then passes through the first and second thread tension conditioners 32 and 33 of the thread condition base 30, the thread guide 34, and the thread guide 73 of the looper support 13, and finally is guided to the corresponding looper 17.

Figure 12:
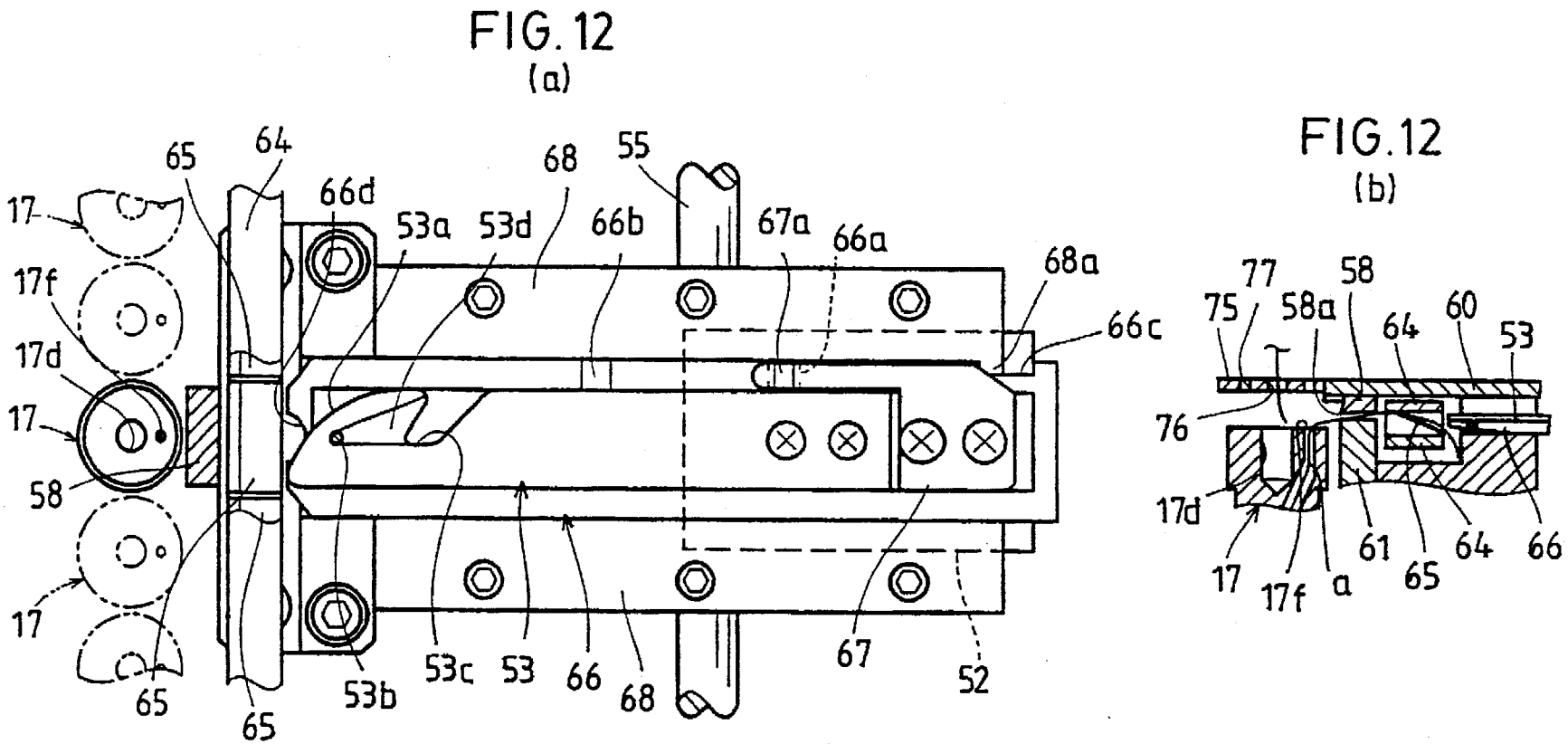
FIGS. 12(*a*) and 12(*b*) are diagrams for explaining how a sewing thread is cut by the thread cutting mechanism.

Now, the operation of the thread cutter of the chain stitch sewing machine according to the embodiment of the present invention will be described. Assume that different sewing threads different in color have been set to each looper 17 of the looper support 13 and, as shown in FIG. 12(*b*), each sewing thread a, conducted from the thread conduction outlet 17*f*, has been held by the hold plate 65. When, in this state, a sewing operation is started, initially the selection of a sewing thread a (looper 17) is performed. At the time of this looper selection, the pulse motor 41 is driven by a command manually input from a console panel or an automatic command based on a program. The rotation of the pulse motor 41 causes the rotational shaft 40 connected to the pulse motor 41 to rotate, whereby the first and second plate cams 37 and 46 assume the position shown in FIG. 6(*a*). Then, the press plate 36 corresponds to the position of the minimum diameter of the first plate cam 37 and also the cam follower 45 of the pivot arm 43 corresponds to the position of the minimum diameter of the second plate cam 46. As a result, the thread tension regulating pin 35 of the second thread tension conditioner 33 pushes the press plate 36 and projects toward the first plate cam 37, and consequently, tension is applied to the sewing thread a. At this time, because the free end of the pivot arm 43 is in its lowest position, the driving lever 47 connected to the pivot arm 43 is also lowered to its lower position, and the push-up portion 47*a* of the upper end of the driving lever 47 is spaced from the lower end of the looper 17. Therefore, the looper 17 is held in the lower position (see FIG. 5) where the spur gear portion 17*b* of the looper 17 is contacted with the top surface 13*a* of the looper support 13, and at the same time, the positioning pin 27 of the front plate 26 fixed to the front surface of the looper support 13 is fitted into the tooth space of the spur gear portion 17*b* of the looper 17.

Thereafter, the looper selecting mechanism 25 is operated by a command manually input from a console panel or an automatic command based on a program. Then, the looper support 13 is slid by the connecting rod 23 and a desired looper 17 is selected. If this looper selecting operation ends, then the rotational shaft 40 of the pulse motor 41 will rotate in the counterclockwise direction, as shown by an arrow in FIG. 6(*b*), and the cam follower 45 of the pivot arm 43 will be moved to the position of the maximum diameter of the second plate cam 46. With this movement, the pivot arm 43 rotates in the clockwise direction and the driving lever 47 moves up, whereby the looper 17 in the selected position is pushed up by the push-up portion 47*a* of the driving lever 47. Then, as shown in FIGS. 4 and 5, the spur gear portion 17*b* of the selected looper 17 is disengaged from the aforementioned positioning pin 27 and meshes with the spur gear portion 20*a* of the driving gear 20 provided in the front end of the gear box 11. In FIG. 3, the third looper 17 from the fight of the looper support 13 is selected. As previously described, the spur gear portion 17*b* of this selected looper 17 is engaged with the spur gear portion 20*a* of the driving gear 20.

Figure 8:
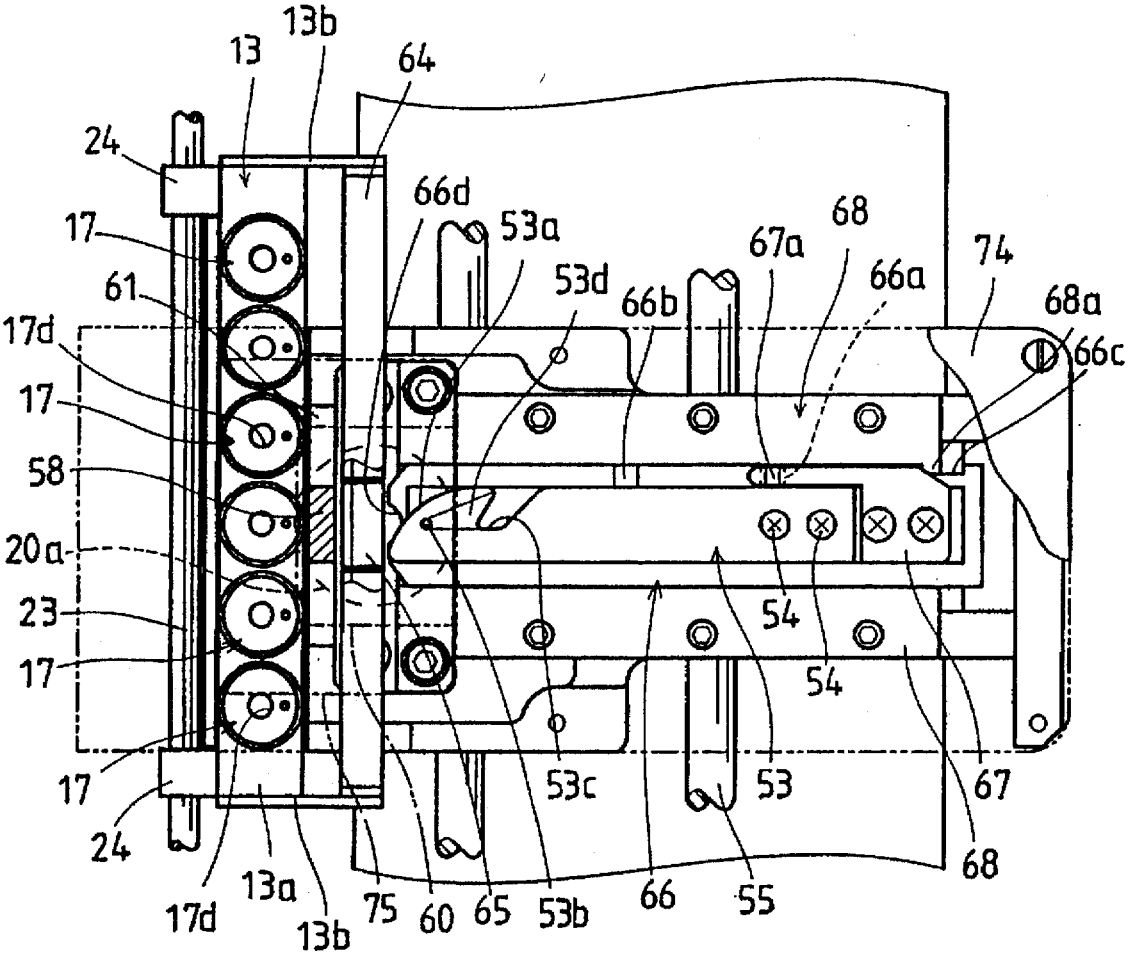
FIG. 8 is a plan view of the looper support and the thread cutting mechanism.
Figure 9:
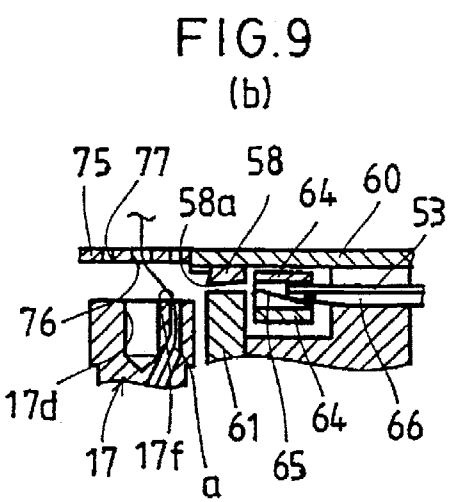
FIGS. 9(*a*) and 9(*b*) are diagrams for explaining how a sewing thread is cut by the thread cutting mechanism.
Figure 9:
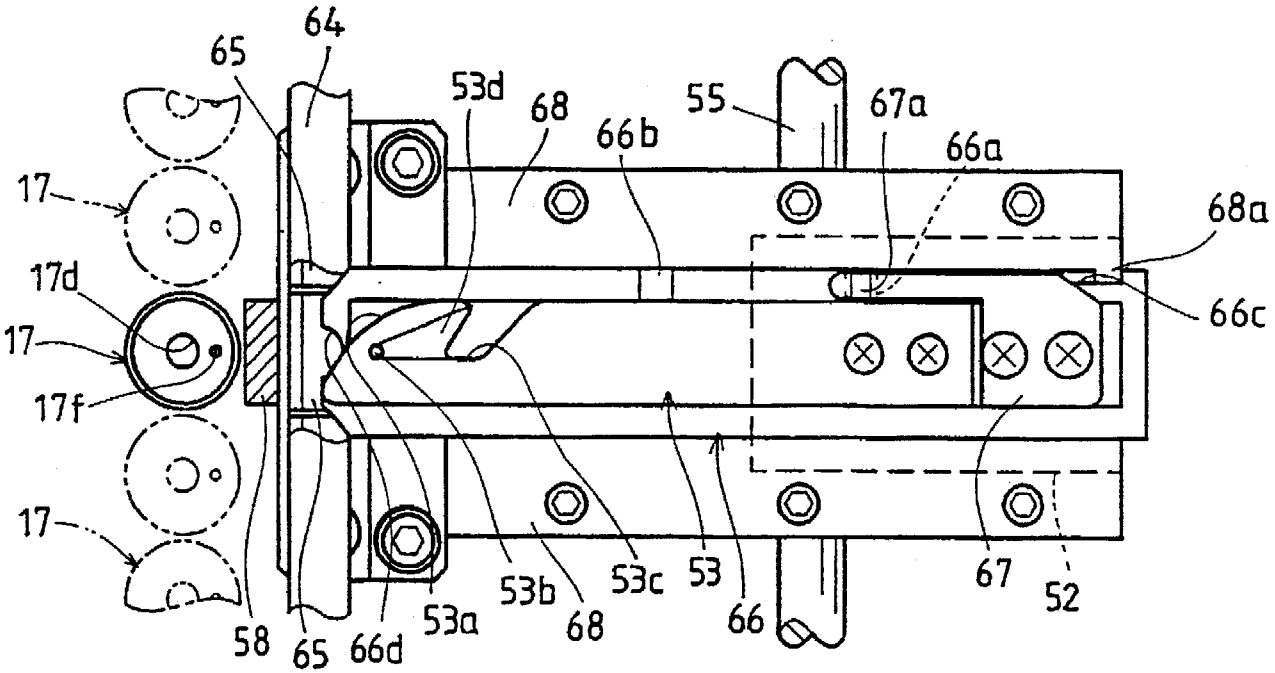

In this state, if a start switch (not shown) on the console panel is switched on, the main machine shaft 3 will be rotated by the driving of the main shaft motor 7 provided on the upper frame 1 and the needle 6 will be lowered. At the time the needle 6 has reached a predetermined lower position, the selected looper 17 is rotated by the driving screw gear 21 and the driving gear 20, thereby threading the needle 6. If the threading operation of this first needle is completed, then the pulse motor 57 of the thread cutting mechanism 50 will be driven and the-knife driving shaft 55 will rotate in the counterclockwise direction of FIG. 4. The counterclockwise rotation of the knife driving shaft 55 causes the slider 52 in the stand-by position to move left (in the direction toward the looper 17), as shown in FIG. 8. At the time of the movement of this slider 52, the projected portion 67*a* of the spring plate 67 has been fitted in the recessed portion of the thread releasing member 66, and consequently, the movable knife 53 and the thread releasing member 66 are integrally moved by the movement of the slider 52. If the front end of the thread releasing member 66 presses the top surface of the hold plate 65, as shown in FIG. 9, then the holding of the sewing thread a will be released and also the driving of the pulse motor 57 will be stopped. After the holding of the sewing thread a is released, the needle 6 moves up and the sewing thread a is pulled up. At the time that the end of the thread, held by the hold plate 65, has been pulled out of the hold plate 65, the pulse motor 57 is driven in the opposite direction and the slider 52 is returned to the stand-by position. Incidentally, as shown in FIG. 13, the front end of the thread releasing member 66 is formed with the escape groove 66*d* so that the releasing of the sewing thread a can be reliably performed without pressing down the sewing thread a on the hold plate 65, when the front end of the thread releasing member 66 presses the top surface of the hold plate 65 to release the holding of the sewing thread a.

When the sewing step by this selected thread a (looper 17) is completed, the looper 17 will be first lowered to the lower position. Specifically, the rotational shaft 40 rotates in the clockwise direction in FIG. 4 by the driving of the pulse motor 41, and the cam follower 45 moves to the minimum diameter of the aforementioned second plate cam 46. With the movement of the cam follower 45, the driving lever 47 interlocking with the cam follower 45 is lowered. Consequently, the looper 17 in the upper position is lowered.

Figure 10:
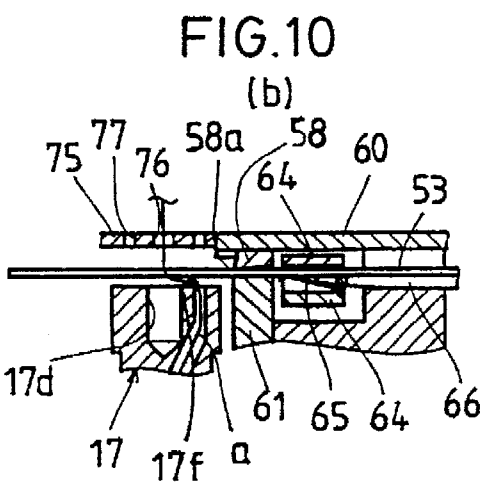
FIGS. 10(*a*) and 10(*b*) are diagrams for explaining how a sewing thread is cut by the thread cutting mechanism.
Figure 10:
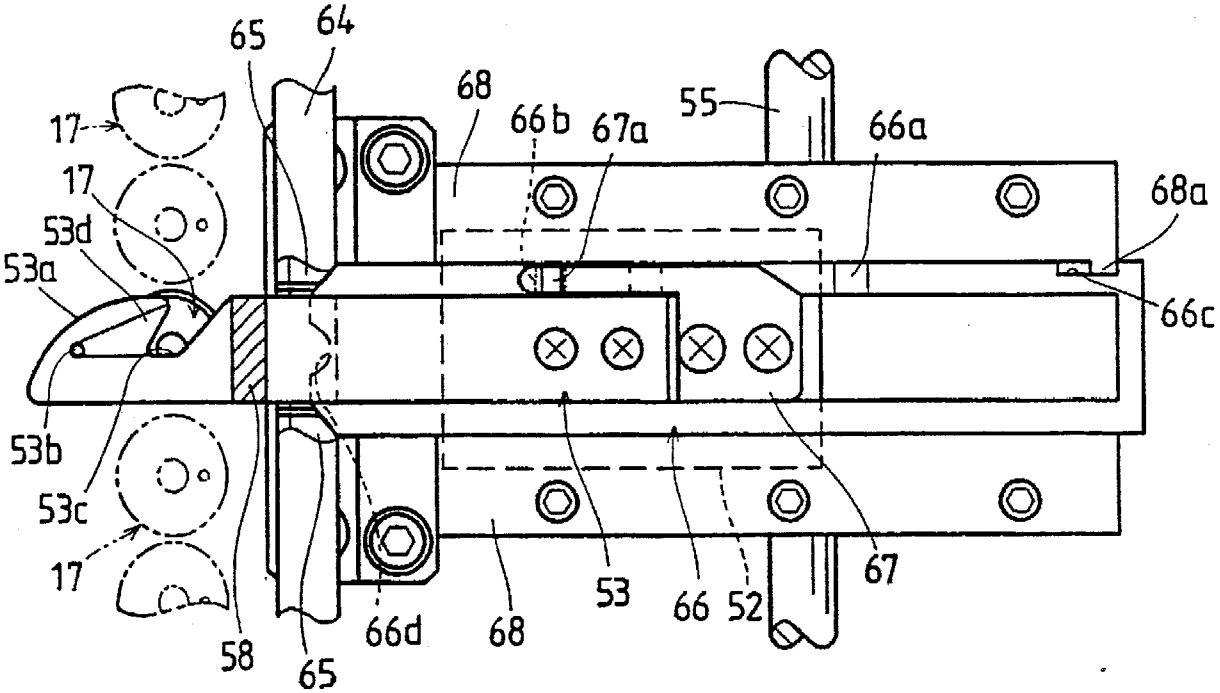
Figure 11:
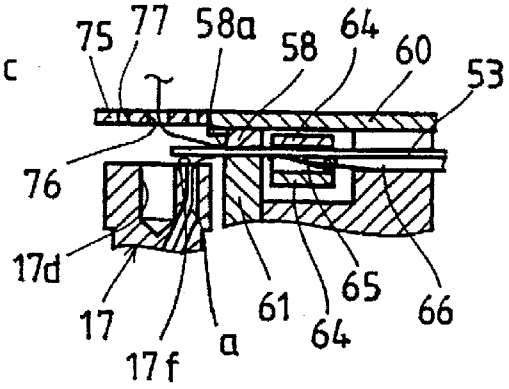
FIGS. 11(*a*) and 11(*b*) are diagrams for explaining how a sewing thread is cut by the thread cutting mechanism.
Figure 11:
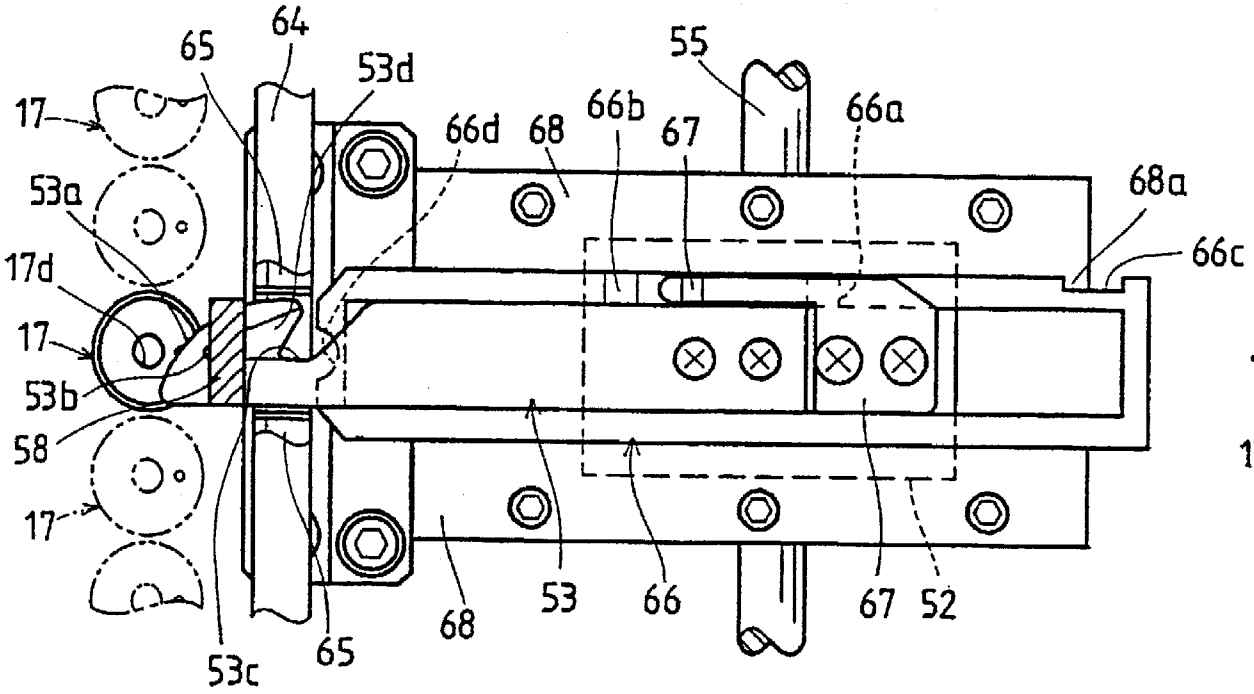

Subsequently, the pulse motor 57 of the thread cutting mechanism 50 is driven and the knife driving shaft 55 rotates in the counterclockwise direction in FIG. 4. With this movement, the movable knife 53, which had been in the stand-by position, is moved left. At the time the movable knife 53 has reached the most projected position thereof, it performs a predetermined operation. After this operation is completed, the pulse motor 57 is driven in the opposite direction and the movable knife 53 returns to the stand-by position, whereby the cutting operation of the sewing thread a and the holding operation of the thread end are performed. These operations will be described in reference to FIGS. 8 through 12. By the driving of the aforementioned pulse motor 57, the slider 52 moves in the direction toward the looper 17. In the initial stage of this operation, the projected portion 67*a* of the spring plate 67 has been fitted in the recessed portion 66*a* of the thread releasing member 66, as previously described. Therefore, the thread releasing member 66 moves together with the movable knife 53. As shown in FIG. 9, at the time the front end of the thread releasing member 66 presses the hold plate 65 and has reached the position where the holding of the sewing thread a is released, the rear wall of the aforementioned cutout 66*c* of the thread releasing member 66 is brought into engagement with the releasing-body regulating pin portion 68*a* of the guide plate 68 disposed on one side of the movable knife 53. As a consequence, thereafter, only the movable knife 53 and the spring plate 67 continue to advance. Then, the sewing thread a, tensioned between the needle dropping hole 76 of the needle plate 75 and the thread conduction outlet 17*f* of the looper 17, is engaged by the thread induction portion 53*a* of the movable knife 53 being passing through the gap between the stationary knife 58 and the supporting block 61 and being advancing toward the sewing thread, whereby the sewing thread is pushed outward. At the time the movable knife 53 has reached the most projected position, as shown in FIG. 10, the sewing thread a is induced by the thread induction portion 53*a* and captured by the thread capturing portion 53*c* of the movable knife 53.

Thereafter, as the movable knife 53 is retracted toward the stand-by position, the sewing thread a is pulled toward the stationary knife 58 by the thread capturing portion 53*c*. As a consequence, the blade portion 53*b* of the movable knife 53 and the stationary knife 53 interfere with each other, thereby cutting the sewing thread a. In cutting, the movable knife 53 is subjected to a downward bending force, but, because it is prevented from being bent downward by the supporting block 61, the sewing thread is cut with reliability. Note that, in the process where the movable knife 53 moves from the most projected position where the sewing thread a is captured to the position where it is cut by the stationary knife 58, the thread releasing member 66 moves and returns to the initial position. More specifically, when the movable knife 53 retracts from the position of FIG. 10, the projected portion 67*a* of the spring plate 67 is fitted into the recessed portion 66*b* of the thread releasing member 66. At this point of time, the thread releasing member 66 retracts together with the movable knife 53, and the thread releasing member 66 retracts until the front wall of the cutout 66*c* thereof is brought into engagement with the releasing-body regulating pin portion 68*a* of the guide plate 68 and thus returns to the original position.

The movable knife 53 continues to retract even after the thread releasing member 66 returns to the original position, and, as shown in FIG. 12, returns to the stand-by position. At this point of time, the projected portion 67*a* of the spring plate 67 is fitted into the rear recessed portion 66*a* of the thread releasing member 66. In the process where the movable knife 53 completes cutting the sewing thread in cooperation with the stationary knife 58 and further retracts to the stand-by position, the end of the sewing thread a on the looper 17 side is dropped from the gap between the thread dropping portion 53*d* and the lower end of the stationary knife 58. At the time the movable knife 53 has returned to the stand-by position, the sewing thread a on the looper 17 side is held between the hold plate 65 and the upper support plate 64 by means of the elastic force of the hold plate 65, as shown in FIG. 12(*b*). Thereafter, the selection of another looper 17 is again started by the sliding motion of the looper support 13, and a multi color sewing operation of different color threads (loopers 17) can be performed by repeating the aforementioned sequence of operations until the thread is cut.

Figure 6:
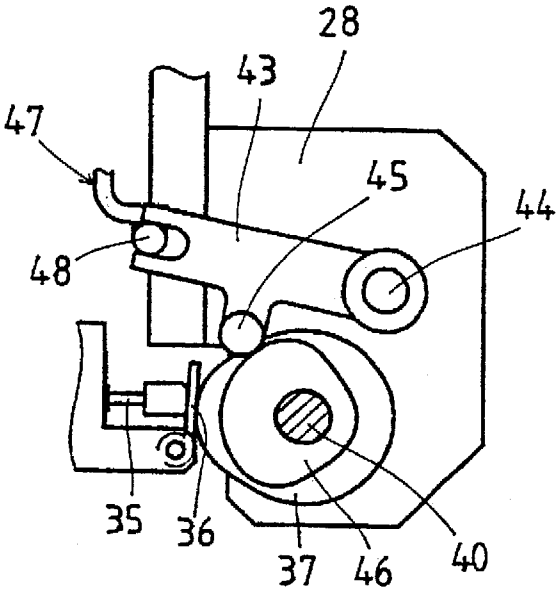
FIGS. 6(*a*), 6(*b*), and 6(*c*) are diagrams for explaining how tension is applied to a sewing thread.
Figure 6:
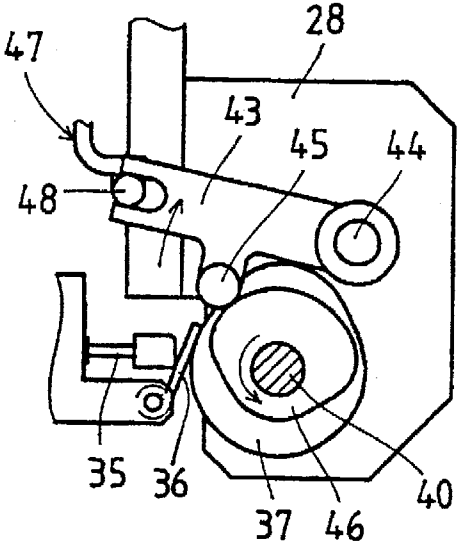
Figure 6:
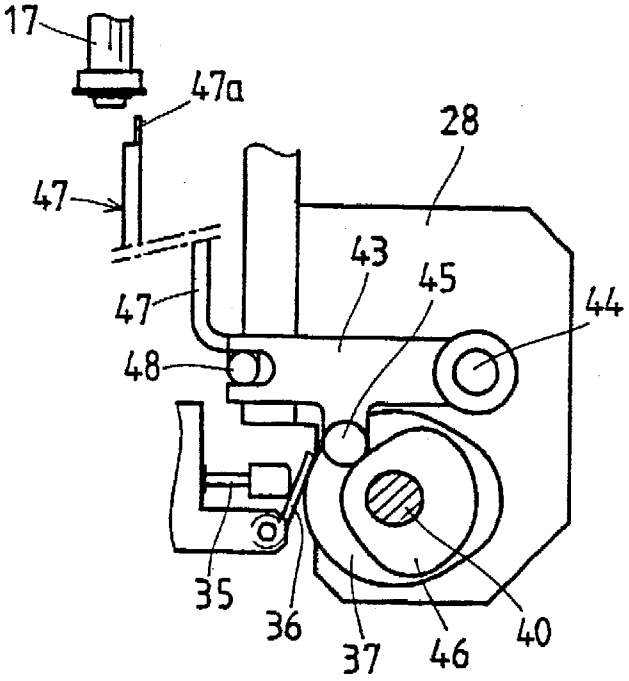

After the selecting operation of the looper 17, it is moved to the upper position by the rotation of the rotational shaft 40, as shown in FIG. 6(*b*), and then if the rotational shaft 40 is further rotated, as shown in FIG. 6(*c*), the position of the maximum diameter of the first plate cam 37 will cause the press plate 36 to rotate. The rotation of the press plate 36 causes the thread tension regulating pin 35 of the second thread tension conditioner 32 to be pushed. With this operation, the tension, applied to the sewing thread a by the second thread tension conditioner 32, is released. Therefore, the application of tension force to a sewing thread a can be controlled and selected by whether the rotational shaft 40 is further rotated after the looper 17 is moved to the upper position by the rotation of the rotational shaft 40, and an appropriate thread tension conditioner can be thus obtained with respect to loop sewing and chain sewing.

Thus, in accordance with the thread cutter for a chain stitch sewing machine of the present invention, the holding of a sewing thread remaining on the looper side after the cutting of the sewing thread, can be performed with a simple structure where there are few components, and consequently, there is the advantage that production cost is reduced and that reliability in operation is enhanced. In addition, when a sewing operation is started, the held state of a sewing thread can be released with reliability by the thread releasing member, and consequently, the sewing operation thereafter can be smoothly performed without any difficulty. Moreover, by threading the loopers of the looper support with different kinds of sewing threads, there is the advantage that composite embroidery of threads of different kinds can be performed.

(Second embodiment)

A preferred embodiment of a drive unit for a multi-head sewing machine according to the present invention will hereinafter be described in detail while referring to the accompanying drawings. In the following embodiment, the drive unit of the invention is applied to a multi-head chain stitch sewing machine.

Figure 14:
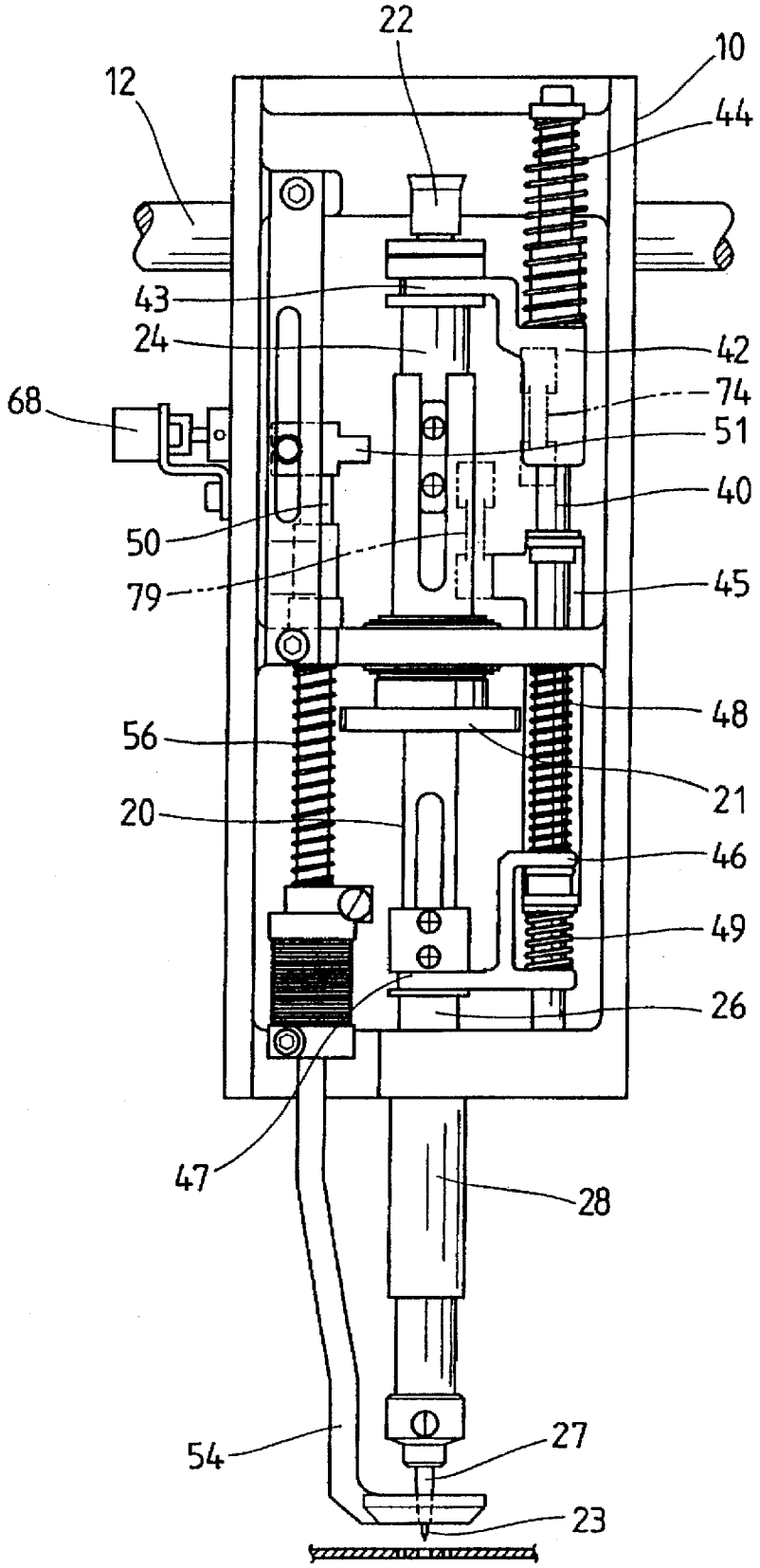
FIG. 14 is a front elevational view showing an individual machine head of a multi-head chain stitch sewing machine to which a drive unit according to the second aspect of the present invention may be applied.
Figure 15:
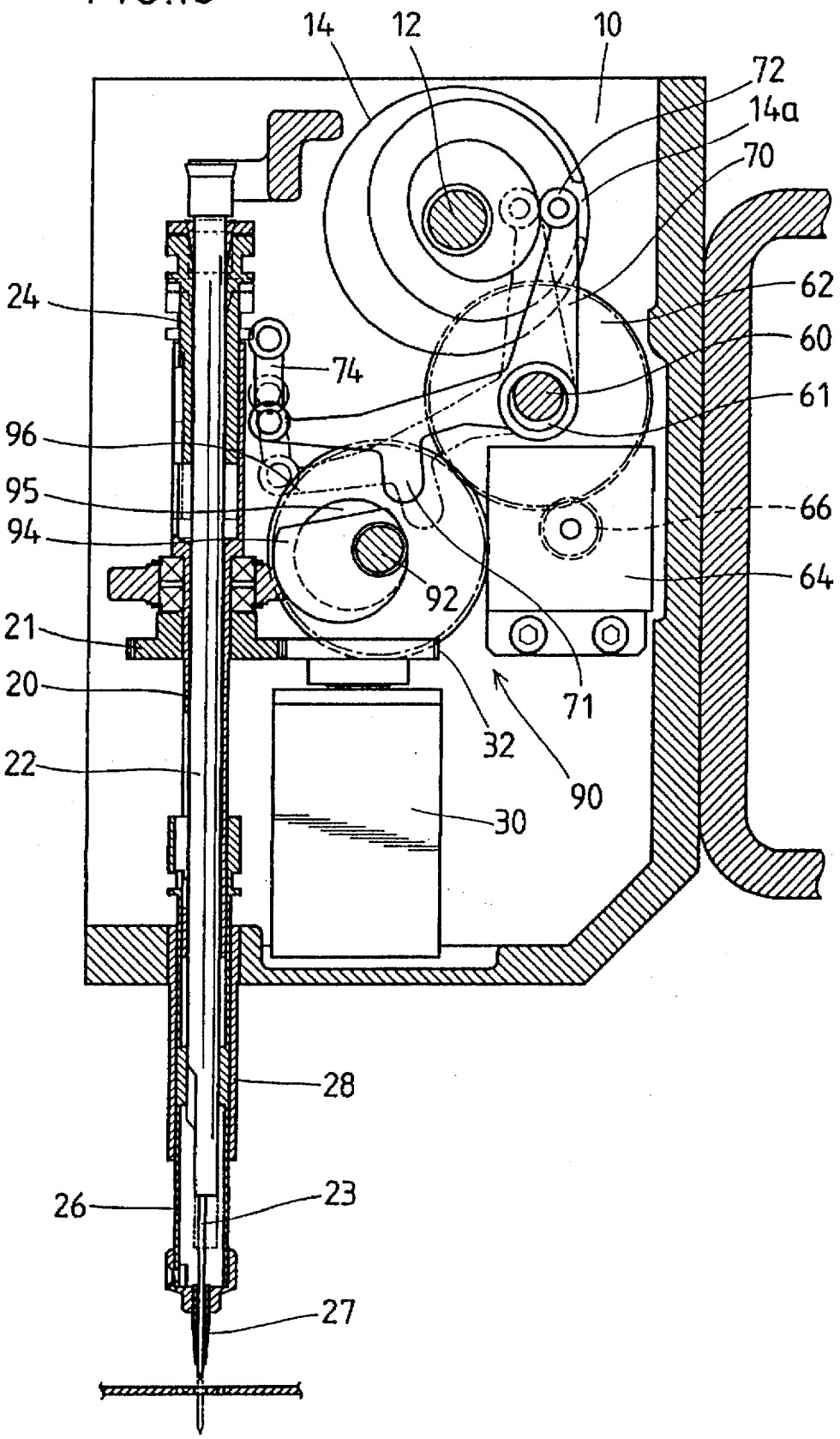
FIG. 15 is a vertical sectional view of the machine head.
Figure 16:
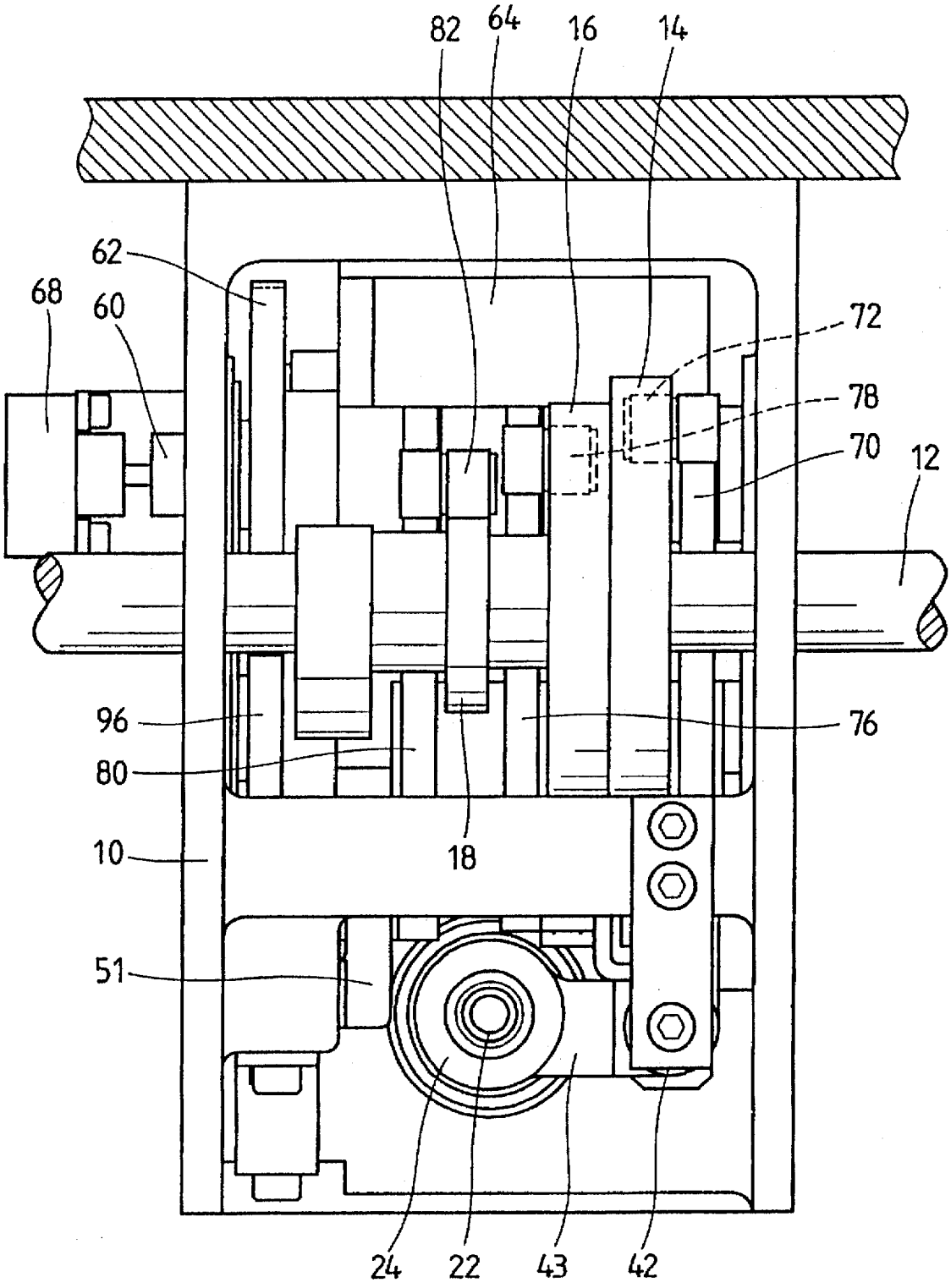
FIG. 16 is an enlarged plan view of the machine head.

As shown in FIGS. 14 to 17, a main machine shaft 12 penetrates a machine arm 10. The main machine shaft 12 likewise penetrates other machine arms (not shown) of the machine head and is rotated in one direction by a drive source (not shown) such as a motor. As shown in FIG. 16, a needle bar cam 14, a nipple cam 16, and a cloth pressing cam 18 are fixed on the main machine shaft 2 in the machine arm 10.

A rotational sleeve 20 in the form of a cylinder is supported at the lateral central portion of the arm 10 by the machine arm 10 so that it can freely rotate about its own axis. As clearly shown, for example, in FIG. 15, a needle bar 22 is assembled into the inner periphery of the rotational sleeve 20 so that it can be moved up and down. This needle bar 22 has a needle 23 mounted in the lower end thereof, and a cylindrical annular needle bar base 24 is fixed around the outer periphery of the upper portion of the needle bar 22. This needle bar base 24 is guided by the upper inner peripheral surface of the aforementioned rotational sleeve 20 so that it can move up and down together with the needle bar 22. In addition, the rotational sleeve 20 and the needle bar 22 are integrally rotatable about their own axes through the needle bar base 24.

A nipple base 26 is disposed around the outer periphery of the lower end portion of the rotational sleeve 20. This nipple base 26 is guided by the inner peripheral surface of a guide sleeve 28 fixed to the machine arm 10 so that the nipple base 26 can move up and down. This nipple base 26 is also rotatable about its axis together with the rotational sleeve 20. The lower end of the nipple base 26 is connected to a nipple 27.

Figure 17:
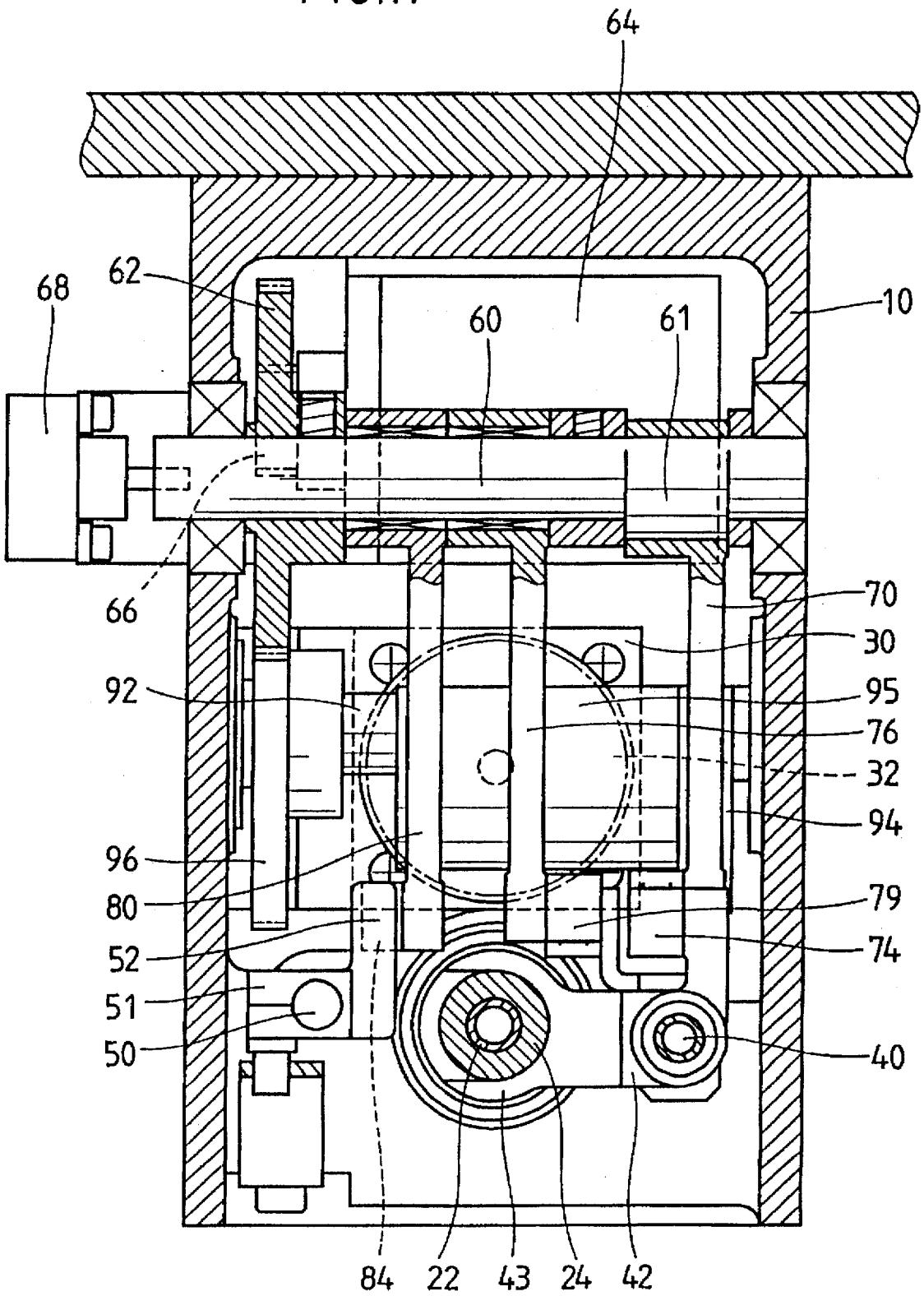
FIG. 17 is a vertical sectional view of FIG. 16.

As shown in FIGS. 14 and 15, a gear 21 is fixed on the outer periphery of the rotational sleeve 20. Also, a motor 30 is fixed on the inner bottom portion of the machine arm 10, as shown in FIGS. 15 and 17. A driving gear 32 provided in the motor 30 meshes with a gear 21 of the rotational sleeve 20. At the time of the sewing operation (time of chain stitch embroidery), the rotational sleeve 20 is rotated about the axis thereof by the driving of the motor 30, and in association with this, the direction of the needle bar 22 (needle 23) and the direction of the nipple 27 will be controlled in correspondence with the sewing direction.

A guide shaft 40, as shown in FIGS. 14 and 17, is fixed to the machine arm 10 at the right of the rotational sleeve 20 (or needle bar 22). On the axis of this guide shaft 40, a needle bar elevating member 42 is supported so that it can move up and down, and nipple elevating members 45 and 46 are supported so that they can move up and down.

The needle bar elevating member 42 is elastically urged downward at the upper portion thereof by means of a spring 44 provided on the guide shaft 40. This urging force, as will be described later, acts on a needle bar driving lever 70. Also, the needle bar elevating member 42 is integrally formed with a bifurcated claw 43, which is engaged with an annular groove formed in the outer periphery of the needle bar base 24. Therefore, if the needle bar elevating member 42 is driven vertically along the guide shaft 40, in association with this movement, the needle bar 22 will be moved up and down together with the needle 23.

Figure 18:
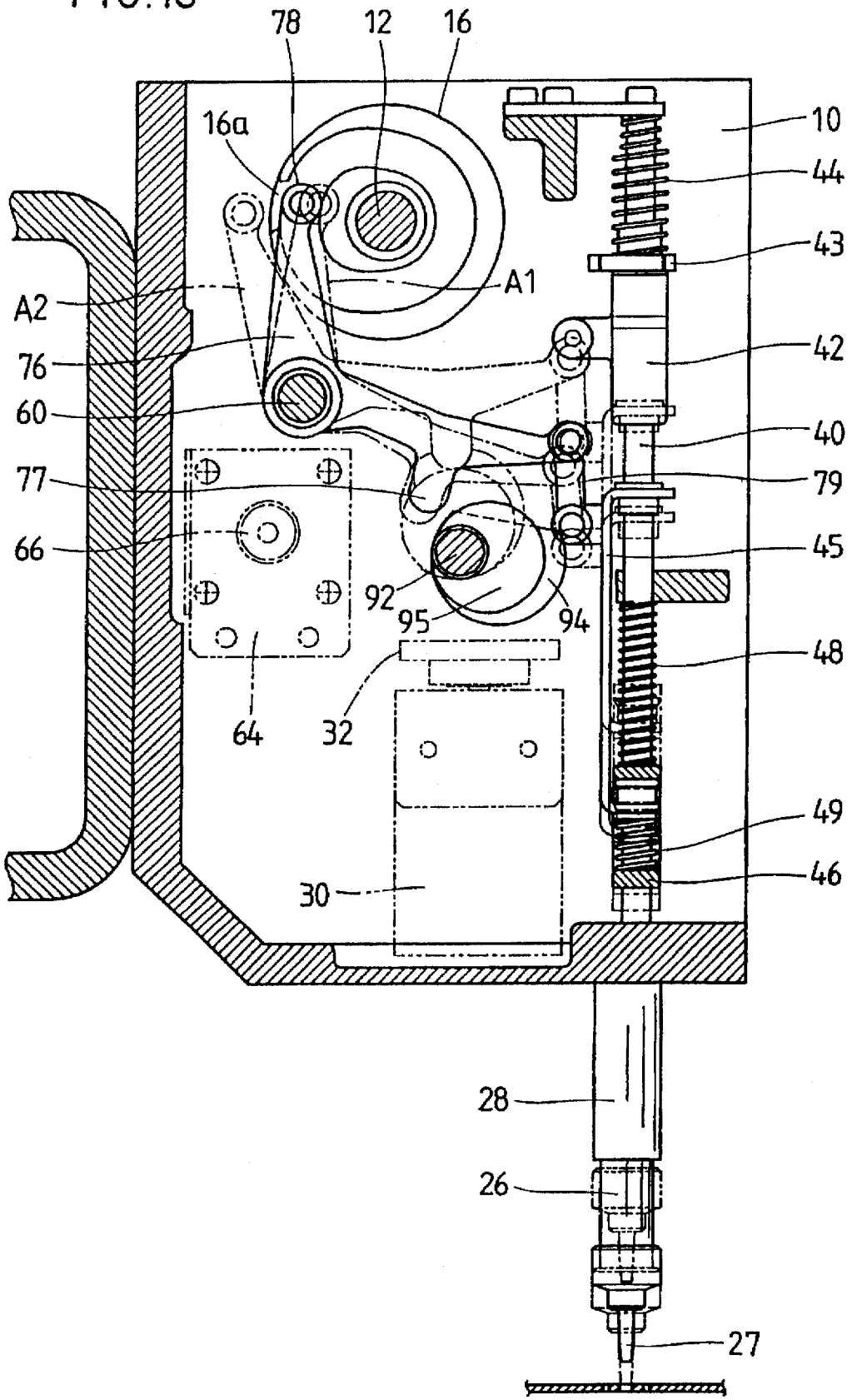
FIG. 18 is a sectional view of the machine head viewed from the opposite side of FIG. 15.

FIG. 18 is a sectional view of the machine head viewed from the opposite side of FIG. 15. As can be seen from FIG. 18, the nipple elevating members 45 and 46 are separate members, but they are moved up and down with an integral relationship at all times by the elastic force of a spring 49 interposed between the members 45 and 46. Furthermore, these nipple elevating members 45 and 46 are urged downward by the elastic force of an upper spring 48. This urging force, as will be described later, acts on the nipple driving lever 76. Furthermore, a claw 47, as shown in FIG. 14, is formed integrally in the elevating member 46 and is engaged with an annular groove formed in the outer periphery of the nipple base 26. Therefore, if the nipple elevating members 45 and 46 are driven along the guide shaft 40, in association with this movement, the nipple 27 will be moved up and down correspondingly.

As shown in FIGS. 14 and 17, an elevating shaft 50 is supported at the left of the rotational sleeve 20 (or needle bar 22) by the machine arm 10 so that the shaft 50 can move up and down. The upper end portion of this elevating shaft 50 is fixed to a clamp member 51 provided with a lever pin 52, while the lower end portion thereof is fixed to the proximal portion of a cloth pressing member 54. The "cloth pressing" used herein means both the case including a nipple and the case of only a nipple.

Figure 19:
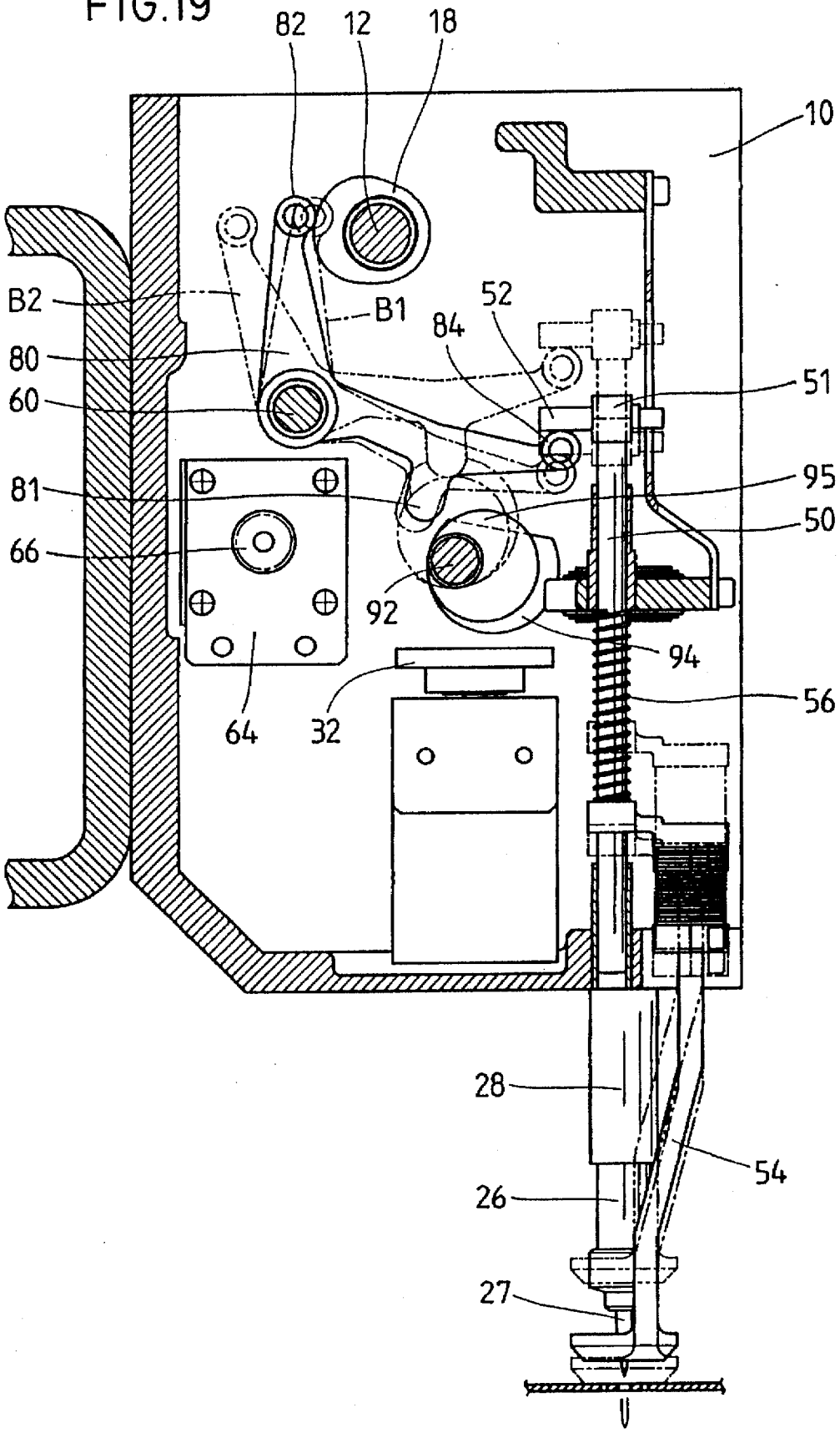
FIG. 19 is a vertical sectional view showing the periphery of the elevating shaft of the machine head.

FIG. 19 is a sectional view showing the periphery of the elevating shaft 50 of the machine head. As is apparent from FIG. 19, with the rotation of the elevating shaft 50 regulated, the elevating shaft 50 can move up and down with respect to the machine arm 10. The movement of the elevating shaft 50 causes the cloth pressing member 54 to move up and down. A spring 56 is provided on the elevating shaft 50 between the proximal end portion of the cloth pressing member 54 and the machine arm 10, and with the elastic force of the spring 56, the elevating shaft 50 is urged downward. This urging force, as will be described later, acts on a cloth pressing lever 80 through the lever pin 52.

As mainly shown in FIGS. 15 and 17, the opposite end portions of a support shaft 60, disposed in parallel with the main machine shaft 12, is freely rotatably supported by the machine arm 10. As clearly shown in FIG. 17, the needle bar driving lever 70, the nipple driving lever 76, and the cloth pressing member driving lever 80 are rotatably mounted on the support shaft 60. As clearly shown in FIGS. 15 and 17, a gear 62 is fixedly mounted on the support shaft 60. This gear 62 meshes with a driving gear 66 of a motor 64 fixed to the machine arm 10. Therefore, the rotation of the support shaft 60 about its own axis can be controlled by this motor 64. The motor 64 also serves as an actuator for a retracting mechanism 90 to be described later.

As can be seen from FIG. 15, the needle bar driving lever 70 is mounted at its nearly intermediate portion on an eccentric portion 61 of the support shaft 60, and consequently, the fulcrum of rotation of the needle bar driving lever 70 can be varied by controlling the rotation of the support shaft 60. A roller 72 provided in one end of the needle bar driving lever 70 is engaged with the cam groove of the needle bar cam 14, while the other end of the lever 70 is connected through a connecting member 74 to the needle bar elevating member 42. Then, if the needle bar cam 14 rotates together with the main machine shaft 12, in association with this movement, the needle bar driving lever 70 will be moved reciprocatingly and the needle bar elevating member 42 will be moved up and down on the guide shaft 40.

The nipple driving lever 76 is mounted at the nearly intermediate portion thereof on the support shaft 60 as shown in FIG. 18. A roller 78 provided in one end of the nipple driving lever 76 is engaged with the cam groove of the nipple cam 16, while the other end of the lever 76 is connected through a connecting member 79 to the nipple elevating member 45. Therefore, if the nipple cam 16 rotates together with the main machine shaft 12, then the nipple driving lever 76 will be moved reciprocatingly in association with the rotation of the nipple cam, and both the nipple elevating members 45 and 46 will be moved up and down on the guide shaft 40.

As can be seen from FIG. 19, the cloth pressing member driving lever 80 is mounted at the nearly intermediate portion thereof on the support shaft 60. A roller 82 provided in one end of the cloth pressing member driving lever 80 is brought into contact with the outer periphery of the cloth pressing cam 18, while a roller 84 provided in the other end of the lever 80 is brought into engagement with the under surface of the lever pin 52 of the elevating shaft 50.

The needle bar cam 14 and nipple cam 16, which are constituted as groove cams, are respectively provided with cutout portions **14*a* and 16*a* for opening part of the cam groove, as shown in FIGS. 15 and 18. As previously described, the needle bar driving lever 70 is elastically urged by the spring 44 acting on the needle bar elevating member 42. Also, the nipple driving lever 76 is elastically urged by the spring 48 acting on the nipple elevating members 45 and 46. Therefore, the rollers 72 and 78 of the driving levers 70 and 76 are positioned in the cam grooves at all times even at the cutout portions 14*a* and 16*a* of the needle bar cam 14 and the nipple cam 16, respectively. In addition, because the cloth pressing lever 80 is elastically urged by the spring 56 acting on the elevating shaft 50, one roller 82 is always contacted with the outer peripheral surface of the cloth pressing cam 18 and the other roller 84 is always contacted with the lever pin 52**.

Now, a description will be made of the retracting mechanism 90 for upwardly retracting the needle bar 22, nipple 27, and cloth pressing member 54. As shown in FIGS. 15, 18, and 19, a cam shaft 92 is disposed in parallel with the main machine shaft 12 and the support shaft 60 and is rotatably supported by the machine arm 10. Two retracting cams 94 and 95 are fixed on the cam shaft 92. Also, the needle bar driving lever 70, the nipple driving lever 76, and the cloth pressing member driving lever 80 are provided with projected portions 71, 77, and 81, respectively. One retracting cam 94, as shown in FIG. 15, is engageable with the projected portion 71 of the needle bar driving lever 70, while the other retracting cam 95 is engageable with the projected portions 77 and 81 of the nipple driving lever 76 and the cloth pressing member driving lever 80, as shown in FIGS. 18 and 19.

As shown in FIGS. 15 and 16, a gear 96 is fixed on the cam shaft 92. This gear 96 meshes with the gear 62 of the support shaft 60. Therefore, when the motor 64 is driven, the rotation of the cam shaft 92 will be controlled together with the retracting cams 94 and 95 by the rotation of the support shaft 60. As shown in FIGS. 14, 16, and 17, an angle detector 68 is provided in one end of the support shaft 60. The rotational angles of the support shaft 60 and the cam shaft 92 can be detected by this angle detector 68.

Now, a description will be made of the operation of the drive unit constructed as described above. Initially, at the time of the sewing operation (chain stitch embroidery), the main machine shaft 12 is driven so that the needle bar cam 14, the nipple cam 16, and the cloth pressing cam 18 are rotated together. As the needle bar cam 14 is rotated, the needle bar driving lever 70 repeats a reciprocating movement between a solid line and an imaginary broken line shown in FIG. 15. As the needle bar elevating member 42 is moved up and down, the needle bar 22 is moved up and down together with the needle 23.

In addition, as the nipple cam 16 is rotated, the nipple driving lever 76 repeats a reciprocating movement between a solid line and an imaginary broken line A1 shown in FIG. 18. As the nipple elevating members 45 and 46 are moved up and down, the nipple 27 is moved up and down. Moreover, as the cloth pressing cam 18 is rotated, the cloth pressing member driving lever 80 repeats a reciprocating movement between a solid line and an imaginary broken line B1 shown in FIG. 19. As the elevating shaft 50 is moved up and down, the cloth pressing member 54 is moved up and down. As the needle bar 22 (needle 23) and nipple 27 move up and down, the directions of the bar 22 and the nipple 27 are controlled in correspondence with the sewing direction by the driving of the motor 30. With this operation, a chain stitch sewing operation is performed in cooperation with a looper (not shown).

Figure 20:
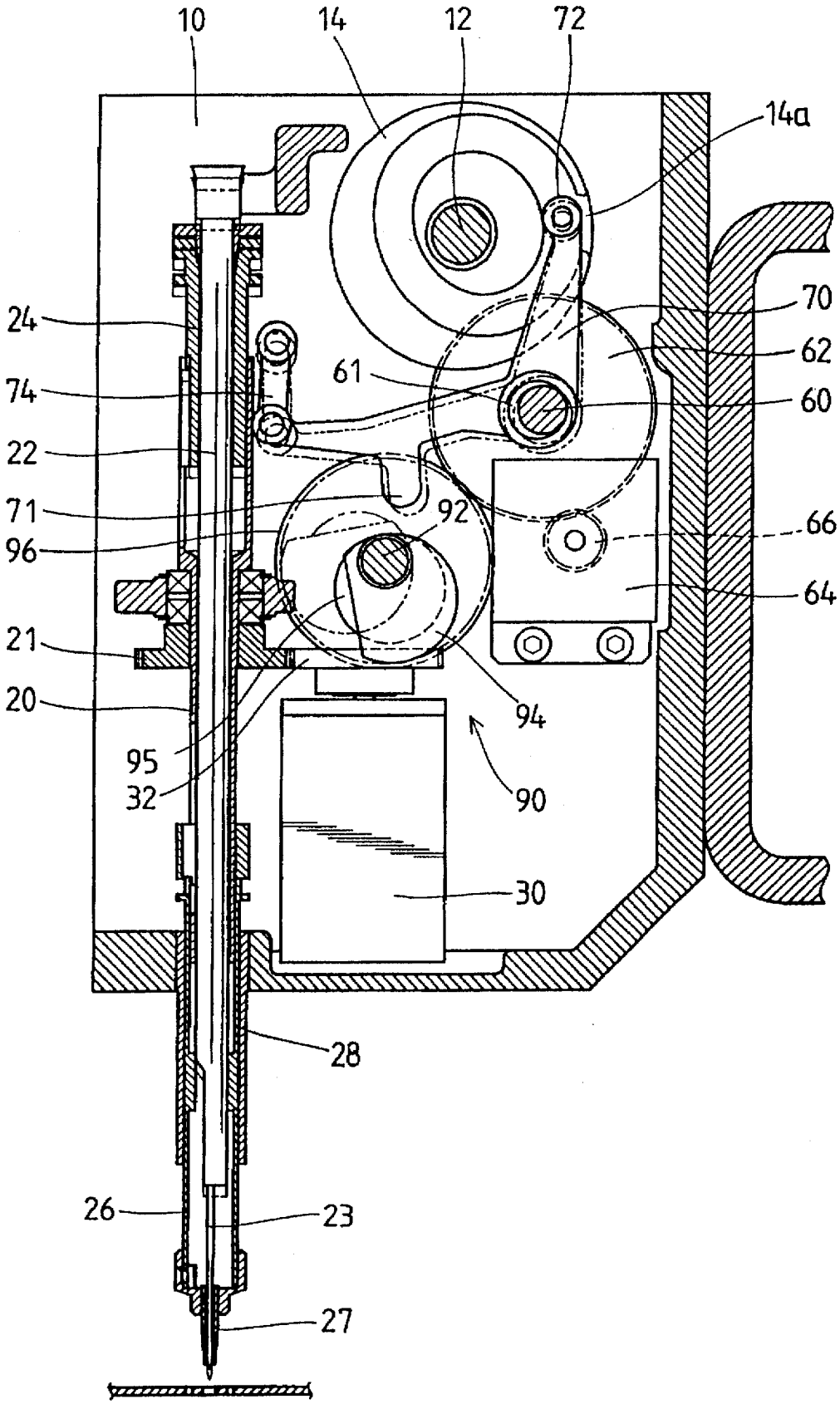
FIG. 20 is a vertical sectional view showing how the fulcrum of movement of the needle bar driving lever is varied.

As has been described, by varying the fulcrum of rotation of the needle bar driving lever 70 by the driving of the motor 64, the top dead point of the rotation of the needle bar driving lever 70 can be arbitrarily set between a solid line and an imaginary broken line shown in FIG. 20. With this setting, change in the elevating stroke of the needle bar 22 is possible. At this time, the control of the rotation of the support shaft 60 is performed with the main machine shaft 12 stopped in a predetermined position of rotation. Note that, although the driving of the motor 64 causes the cam shaft 92 of the retracting mechanism 90 to rotate, there is no possibility that the retracting cams 94 and 95 of the retracting mechanism 90 contact with the projected portions 71, 77, and 81 of the driving levers 70, 76, and 80.

Now, a description will be made of a case where the needle bar 22, the nipple 27, and the cloth pressing member 54 are retracted by the retracting mechanism 90 when exchanging a piece of cloth. Even in this case, the main machine shaft 12 is stopped at a predetermined rotational position, that is, a position where the cutout portion 14*a* of the needle cam bar 14 and the cutout portion 16*a* of the nipple cam 16 correspond to the roller 72 of the needle bar driving lever 70 and the roller 78 of the nipple driving lever 76.

Figure 21:
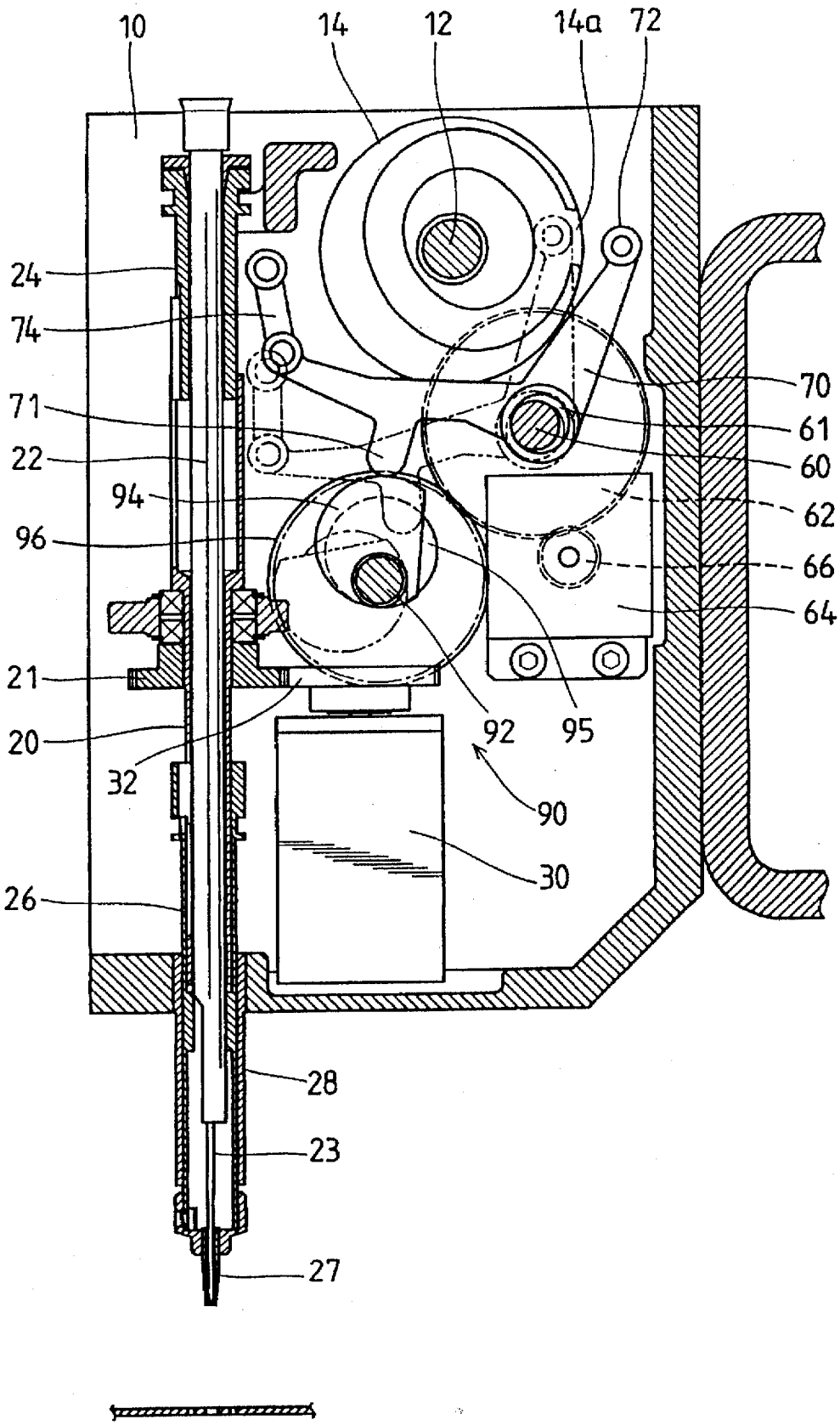
FIG. 21 is a vertical sectional view showing the retracted state of the needle bar driving lever.

Then, the cam shaft 92 is rotated by driving the motor 64 so that the retracting cams 94 and 95 are rotated to the solid-line positions shown in FIG. 21. With this rotation, the projected portion 71 of the needle bar driving lever 70 is pushed by one retracting cam 94, and as shown by the solid line in FIG. 21, the projected portion 71 rotates upward beyond the rotational range where the sewing operation is performed. In addition, the other retracting cam 95 pushes up the projected portions 77 and 81 oft he nipple driving lever 76 and cloth pressing member driving lever 80, respectively. As a consequence, the nipple driving lever 76, as shown by an imaginary broken line A2 in FIG. 18, rotates upward beyond the rotational range where the sewing operation is performed. The cloth pressing member driving lever 80, as shown by an imaginary broken line B2 in FIG. 19, rotates upward beyond the rotational range where the sewing operation is performed. Thus, the needle bar 22, the nipple 27, and the cloth pressing member 54 retract to the upper positions beyond the respective top dead points of the sewing operation.

At the time of the aforementioned retracting operation, the rollers 72 and 78 of the needle bar driving lever 70 and nipple driving lever 76, as shown by a solid line in FIG. 21 and by an imaginary broken line A2 in FIG. 18, are disengaged from the respective cam grooves through the cutout portions 14*a* and 16*a* of the needle bar cam 14 and nipple cam 16, respectively. Also, the roller 82 of the cloth pressing member driving lever 80, as shown by an imaginary broken line B2 in FIG. 19, is disengaged from the outer periphery of the cloth pressing cam 18. Therefore, at the time of this retracting operation, the interlocked relationship between the main machine shaft 12 (needle bar cam 14, nipple cam 16, and cloth pressing cam 18) and each of the driving levers 70, 76, and 80 is cut off.

Therefore, if the retracting operation of an arbitrary machine head of a multi-head sewing machine is performed, the needle bar 22, nipple 27, and cloth pressing member 54 of that machine head will not be driven and will remain in the stopped states, even when the main machine shaft 12 is restarted later. Because the interlocked state between each of the needle bar cam 14, nipple cam 16, and cloth pressing cam 18 and each of the driving levers 70, 76, and 80 is cut off at the time of the retracting operation, restriction on the upward movement quantities of the driving levers 70, 76, and 80 is considerably relaxed, and consequently, the needle bar 22, the nipple 27, and the cloth pressing member 54 can be retracted to a sufficient height.

In accordance with the drive unit of the second embodiment of the present invention, if only the retracting operation of the needle bar and cloth pressing member of an arbitrary machine head of a multi-head sewing machine is performed, the interlocked relationship between the needle bar cam and the needle bar driving lever and between the cloth pressing member and the cloth pressing member driving lever can be cut off. Therefore, an arbitrary machine head can be stopped without using a clutch mechanism which has so far been provided in each machine head, thus realizing the drive unit with simpler structure.

What is claimed is:

1. A thread cutter for a chain stitch sewing machine which performs chain stitch sewing by cooperation of a needle driven up and down and each of a plurality of loopers arranged under a needle plate, comprising:

a looper support for supporting said plurality of loopers, the looper support being slidably arranged under said needle plate;

a looper selecting mechanism for sliding said looper support so that one of said plurality of loopers is positioned opposite and under said needle;

a movable knife arranged so that it advance into or retracts from a gap between a top surface of the selected looper and an under surface of said needle plate;

a knife driving mechanism for advancing and retracting said movable knife;

a stationary knife arranged under said needle plate for cutting a sewing thread in cooperation with said movable knife when said movable knife is retracted;

a thread holding plate for holding a cut end of said sewing thread on the side of said looper in a predetermined position by a further retracting operation of said movable knife after said sewing thread is cut; and a thread releasing member provided in said movable knife for releasing the thread holding force of said thread holding plate by a reciprocating operation of said movable knife at the time of sewing.

2. The thread cutter according to claim 1, further comprising:

a thread tension conditioner arranged in each thread supply path of said plurality of loopers for applying a required tension to said sewing thread by an elastic spring force; and a tension regulating mechanism which, regulates said elastic spring force of said thread tension conditioner over at least two stages.

3. A drive unit for a multi-head sewing machine which is provided with a plurality of machine heads each including a main machine head, a needle bar cam and a cloth pressing cam fixed to said main machine shaft so that the needle bar cam and the cloth pressing cam rotate together with said main machine shaft, a needle bar driving lever and a cloth pressing member driving lever which repeat a reciprocating movement over a predetermined range in response to rotation of said needle bar cam and rotation of said cloth pressing cam so that a needle bar and a cloth pressing member move up and down, and a retracting mechanism for rotating said needle bar driving lever and said cloth pressing member driving lever upward beyond said predetermined range so that said needle bar and said cloth pressing member retract upward, and where said main machine shaft penetrates said plurality of machine heads so that it is driven for rotation, characterized in that:

an actuator for driving a corresponding retracting mechanism is individually arranged in a corresponding machine head; and when said retracting mechanism of one of said plurality of machine heads is operated to retract said needle bar and said cloth pressing member, an interlocked relation between said needle bar cam and said needle bar driving lever and an interlocked relation between said cloth pressing cam and said cloth pressing member driving lever are cut off in said one of the plurality of machine heads.

* * * * *

UNITED STATES PATENT AND TRADEMARK OFFICE

CERTIFICATE OF CORRECTION

PATENT NO. : 5,664,511
DATED : September 9, 1997
INVENTOR(S) : Ikuo Tajima, et al.

It is certified that error appears in the above-indentified patent and that said Letters Patent is hereby corrected as shown below:

On the title page, add the following:

--Item [30] Foreign Application Priority Data:

March 14, 1995 [JP] Japan ..... 7-54478--

Signed and Sealed this

Seventeenth Day of February, 1998

Bruce Lehman

*Attest:*

BRUCE LEHMAN

*Attesting Officer*

*Commissioner of Patents and Trademarks*